United States Patent [19]

Edamura

[11] Patent Number: 4,933,527

[45] Date of Patent: Jun. 12, 1990

[54] OVEN AND DETACHABLE FUNCTION UNIT

[75] Inventor: Kaoru Edamura, Nara, Japan

[73] Assignee: Sharp Kabushiki Kaisha, Osaka, Japan

[21] Appl. No.: 308,811

[22] Filed: Feb. 10, 1989

[30] Foreign Application Priority Data

Feb. 19, 1988 [JP] Japan ..... 63-37722

[51] Int. Cl.[5] ..... H05B 6/68

[52] U.S. Cl. ..... 219/10.55 B; 219/506; 99/325

[58] Field of Search ..... 219/10.55 B, 10.55 R, 219/506, 490; 99/325; 364/477; 340/696

[56] References Cited

U.S. PATENT DOCUMENTS

| | | | |
|---|---|---|---|
| 4,309,584 | 1/1982 | Terakami | 219/10.55 B |
| 4,459,449 | 7/1984 | Hirata | 219/10.55 B |
| 4,568,810 | 2/1986 | Carmean | 219/10.55 B |
| 4,725,948 | 2/1988 | Mierzwinski | 219/10.55 B |
| 4,816,635 | 3/1989 | Edamura | 219/10.55 B |
| 4,837,414 | 6/1989 | Edamura | 219/10.55 B |

FOREIGN PATENT DOCUMENTS

| | | | |
|---|---|---|---|
| 54-105317 | 3/1981 | Japan | 219/10.55 R |

OTHER PUBLICATIONS

U.S. patent application, "Control Unit for a Heating System", by Kaoru Edamura, A-44059/KN.

*Primary Examiner*—Philip H. Leung

[57] ABSTRACT

A microwave oven has a detachable function unit which is comprised of cooking information memory, two material inputting device, a cooking information retrieving device, an image display, an image switching device, a cooking program lock, and a cooking program transmitter. The function unit can select a desired cooking program among many cooking programs, thus enabling easy selection and input of a cooking program into a controlling part of the microwave oven.

8 Claims, 20 Drawing Sheets

*Fig. 9*

Data area for retrieving main dish (55)

| address | menu code | main materials code | secondary materials code 1 | secondary materials code 2 | image information code |
|---|---|---|---|---|---|
| 10 | M-01 | SM 01 | SS 04 | SS 02 | V-01 |
| 20 | M-02 | SM 02 | SS 02 | SS 04 | V-02 |
| 30 | M-03 | SM 03 | SS 01 | SS 09 | V-03 |
| 40 | M-04 | SM 04 | SS 05 | SS 07 | V-04 |
| 50 | M-05 | SM 05 | SS 03 | SS 04 | V-05 |
| 60 | M-06 | SM 06 | SS 07 | SS 02 | V-06 |
| 70 | M-07 | SM 07 | SS 02 | SS 03 | V-07 |

Data area for retreiving sub-dish (56)

| | | main dishes code | sub-dishes designation | soup designation | image information code |
|---|---|---|---|---|---|
| 510 | MS 01 | M-02 | O | O | V 55 |
| 520 | MS 02 | M-04 | O | X | V 57 |
| 530 | MS 03 | M-06 | X | O | V 59 |
| 540 | MS 04 | M-02 | O | O | V 61 |
| 550 | MS 05 | M-01 | X | O | V 56 |
| 560 | MS 06 | M-03 | O | X | V 58 |
| 570 | MS 07 | M-05 | O | O | |

Data area for image information (57)

| | image information code | image information | cooking programs code |
|---|---|---|---|
| 1010 | V-01 | ---------- | P-01 |
| 1020 | V-02 | ———————— | P-03 |
| 1030 | V-03 | ———————— | P-07 |
| 1040 | V-04 | ———————— | P-04 |
| 1050 | V-05 | ———————— | P-05 |
| 1060 | V-06 | ———————— | P-07 |
| 1070 | V-07 | | P-02 |

Data area for cooking programs (58)

| | cooking programs code | cooking programs information |
|---|---|---|
| 1510 | P-01 | * * * * * * * * * * * * * * * |
| 1520 | P-02 | - - - - - - - - - - - - - - - |
| 1530 | P-03 | + + + + + + + + + + + + + + + |
| 1540 | P-04 | ———————— |
| 1550 | P-05 | △ △ △ △ △ △ △ △ △ △ △ △ △ △ △ |
| 1560 | P-06 | ---------- |
| 1570 | P-07 | ———————— |

selected routine for cook program of Fig. 10 routine for re-edition of input data flow chart
display output
operation
start
S0a
depression of selected mode for main-dish
S0b
turning on indicating lamp for main material
4
S1a
depression of input switch for main material
S1b
turning on indicating lamp for designating main material
A
31
flashing
beef
tuna
meat
fishes
D1
32
beef
meat
fishes
D2
B
bush
MAIN
O1
36
push
34
beef
meat
fishes
O2
C

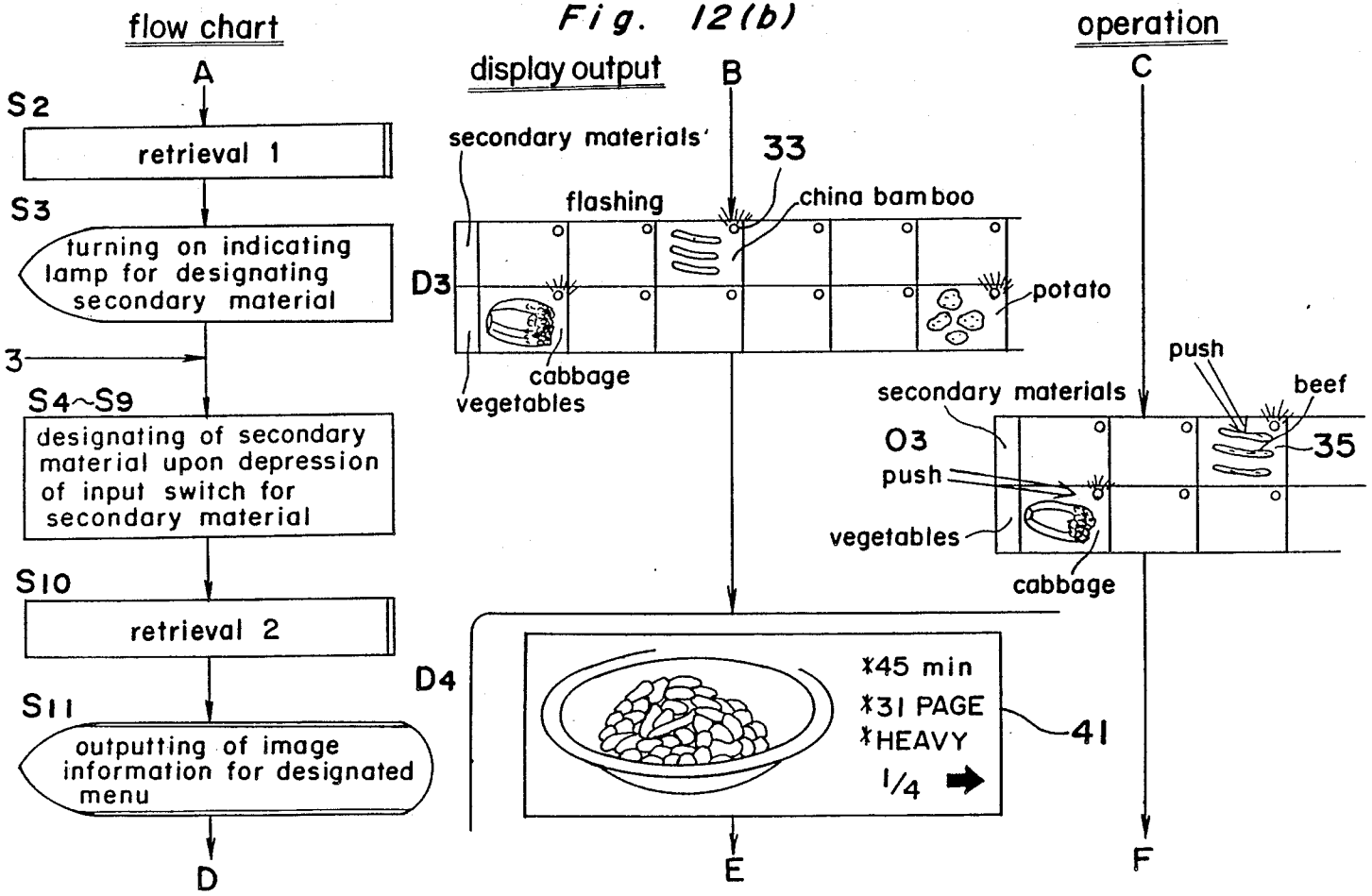
Fig. 12(b)
flow chart
A
S2
retrieval 1
S3
turning on indicating lamp for designating secondary material
3
S4~S9
designating of secondary material upon depression of input switch for secondary material
S10
retrieval 2
S11
outputting of image information for designated menu
D
display output
B
secondary materials'
flashing
33
china bamboo
potato
cabbage
vegetables
D3
operation
C
secondary materials
O3
push
vegetables
cabbage
push
beef
35
F
D4
41
*45 min
*31 PAGE
*HEAVY
1/4
E

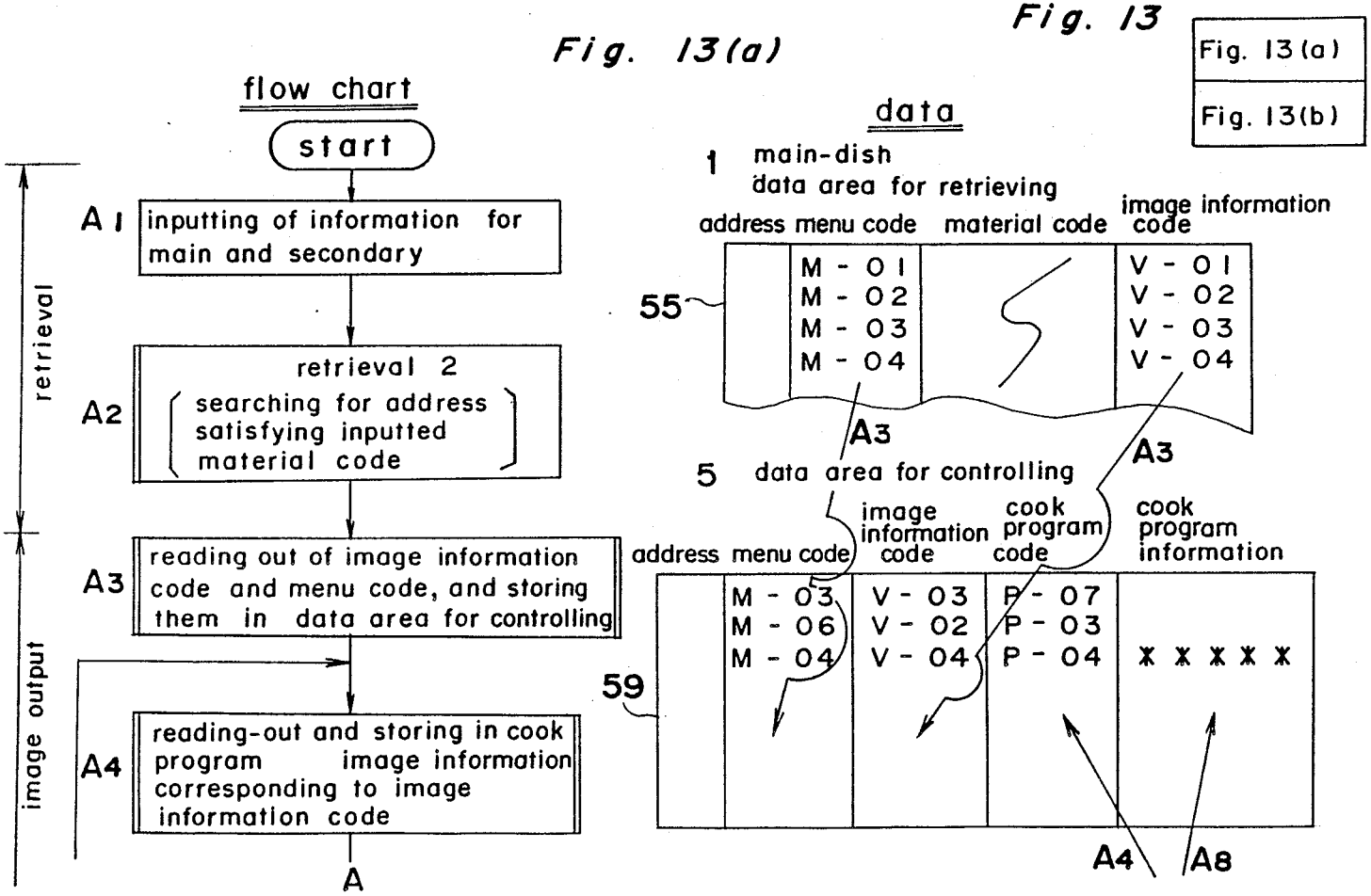
Fig. 13
Fig. 13(a)
Fig. 13(b)
Fig. 13(a)
flow chart
start
A1
inputting of information for main and secondary
A2
retrieval 2
searching for address satisfying inputted material code
A3
reading out of image information code and menu code, and storing them in data area for controlling
A4
reading-out and storing in cook program image information corresponding to image information code
A
retrieval
image output
data
1 main-dish data area for retrieving
address menu code material code image information code
M - 01 M - 02 M - 03 M - 04
V - 01 V - 02 V - 03 V - 04
55
A3
5 data area for controlling
address menu code image information code cook program code cook program information
M - 03 M - 06 M - 04
V - 03 V - 02 V - 04
P - 07 P - 03 P - 04
x x x x x
59
A4
A8

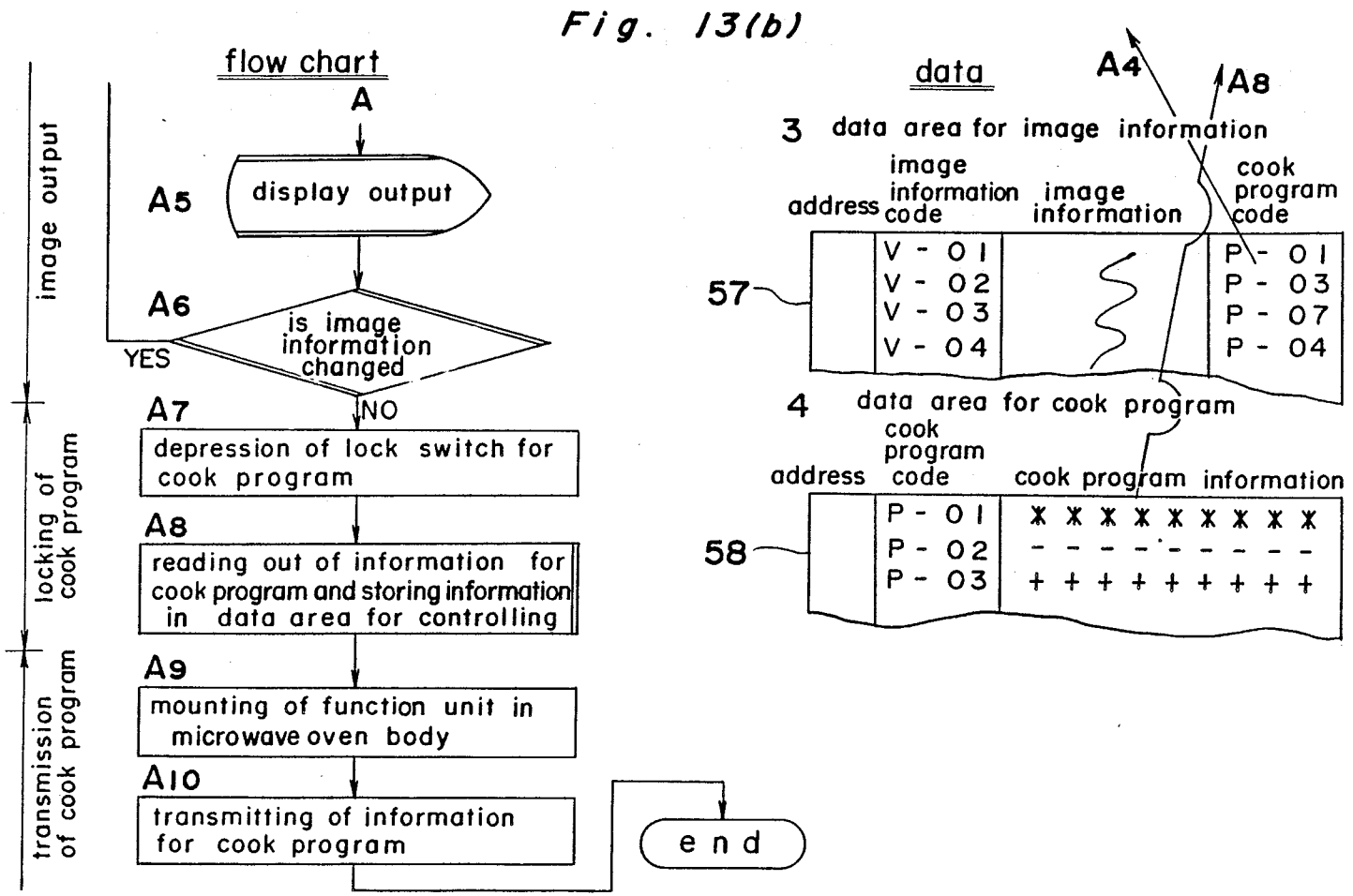
Fig. 13(b)
flow chart
A
A5
display output
A6
is image information changed
YES
NO
A7
depression of lock switch for cook program
A8
reading out of information for cook program and storing information in data area for controlling
A9
mounting of function unit in microwave oven body
A10
transmitting of information for cook program
end
image output
locking of cook program
transmission of cook program
data
3 data area for image information
address
image information code
image information
V - 01
V - 02
V - 03
V - 04
57
A4
A8
cook program code
P - 01
P - 03
P - 07
P - 04
4 data area for cook program
address
cook program code
cook program information
P - 01
P - 02
P - 03
58

OVEN AND DETACHABLE FUNCTION UNIT

BACKGROUND OF THE INVENTION

1. Field of the Invention

The present invention relates to a microwave oven having a microcomputer therein and operating in accordance with cooking programs stored in the microcomputer.

2. Description of the Prior Art

In a conventional microwave oven having a microcomputer, cooking programs stored in the microcomputer are selected and determined in the following manners.

According to a first method, a menu code (numerical code) is assigned to the cooking program for each menu. Therefore, the cooking program of a desired menu can be called up when an operator inputs the menu code of the desired menu, through depression of a numerical key provided in a controlling part of the microwave oven, with reference to the menu codes described in an accompanying cookbook.

According to a second method, a core menu is set among one category of menus (meat, chicken, vegetables, drinks, etc.), and the cooking program for the core menu (basic cooking program) is set. Cooking programs for the other menus belonging to the same category as the core menu are designed and set through modification of the basic cooking program. In the above-described manner, cooking programs are prepared for several kinds of categories of menus. Moreover, a switch exclusively used for calling up the cooking program of a specific menu is provided for each category of menus. The names of the categories and of the menus in each category are indicated on a control unit panel of a controlling part of the microwave oven.

Therefore, the cooking program of the desired menu is called up when the operator selects the name of the menu category including the desired menu, and manipulates the special switch corresponding to the desired menu. The names of the menu categories serve in this case as an index when the operator searches for the special switch corresponding to the desired menu.

However, the above-described conventional coating program selection methods in the microwave oven have such drawbacks as follows.

In other words, according to the above-described first method, it is necessary to correctly input the menu code without fail although it is impossible for the operator to remember all the menu codes . Therefore, it is inconveniently necessary for the operator to look into the cookbook every time the operator selects a menu.

Meanwhile, according to the above-described second method, the number of menus which can be indicated on the control unit panel is limited since the names of all the menus included in each category of menus are arranged to be indicated in the second method.

Although the menus are classified into respective categories in terms of attribute commonness, these menus will not cook an item that if it is to be cooked according to the cooking program of another category having different attributes for example, chicken can not be cooked as well with the cooking program based on the basic cooking program of "domestic fowl", but can be cooked better with the cooking program based on the basic cooking program for "vegetables". It is impossible to always cook the food in the appropriate category. Because, if the cooking program is prepared for each category classified by attributes, the number of the menus entered in each category is lessened, thereby deteriorating the efficiency of the cooking programs.

On the other hand, if one category is set for menus which are based on one basic cooking program, the number of menus able to be entered in the one category is increased. However, the operator can not find the common attribute of the menus included in the one category. Therefore, it is impossible for the operator to decide instantaneously as to which category the desired menu belongs.

What is more important is that the above-described first and second methods are completely useless in the case where the operator has not decided what to eat.

SUMMARY OF THE INVENTION

Accordingly, an essential object of the present invention is to provide an improved microwave oven which can assist an operator in deciding a menu to be cooked, through simple manipulation of the switches, even when the operator has not yet decide which menu to use or the operator does not remember the correct code for the menu since many menus using the materials inputted by a material inputting switch are indicated one by one on a display, so that the cooking program of the decided menu can be easily inputted to a controlling part.

In accomplishing the above-described object, according to the present invention, an improved microwave oven is provided which includes a function unit detachable from a main body of the microwave oven. The above function unit is comprised of a cooking information memory means which memorizes cooking information comprised of at least material information, menu image information and cooking programs in connection with each other, material inputting means each corresponding to a particular material for inputting information of the material, a cooking information retrieving means which, based on the inputted material information by the material inputting means, retrieves menu image information and cooking programs from the cooking information memory means, an image display means for indicating menu image information retrieved by the cooking information retrieving means, an image switching means which changes the menu image information indicated on the image display means to a succeeding menu image information if a lot of menu image information is retrieved by the cooking information retrieving means, a cooking program locking means which locks a cooking program to a predetermined program in accordance with the menu image information indicated by the image display means, and a cooking program transmission means which transmits the cooking program locked by the cooking program locking means to a controlling part of the main body when the function unit is mounted in the main body.

In the microwave oven having the above-described construction, when material information is inputted by the material information inputting means of the function unit detachable from the main body of the microwave oven, menu image information and cooking programs are retrieved by the cooking information retrieving means, on the basis of the inputted material information, among the cooking information recorded by the cooking information memory means. The many retrieved menu image information is changed and indicated one by one by the image information display means and the image switching means. The cooking program is set to a predetermined cooking program of the menu based on the indicated menu image information. Then, when the function unit is installed in the main body of the microwave oven, the locked cooking program is transmitted to the controlling part of the main body. Accordingly, in the microwave oven of the present invention, even when a desired menu is not fixed, inputting of material information is enough to decide the menu, and the cooking program for the decided menu can be transmitted to the controlling part of the main body. Accordingly, in the microwave oven of the present invention, even when a desired menu is not fixed, inputting of material information is enough to decide the menu, and the cooking program for the decided menu can be transmitted easily into the controlling part of the main body of the microwave oven.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become clear from the following description taken in conjunction with the preferred embodiments thereof with reference to the accompanying drawings which are given by way of illustration only, and thus are not limitative of the present invention, and in which:

FIG. 9 is a diagram showing the structure of a memory means in the block diagram of FIG. 8;

FIG. 11(*b*) is a flow-chart of the routine for re-edition of the inputted data;

FIGS. 13, 13(*a*) and 13(*b*) are diagrams showing the flow of information when the cooking program is selected.

DETAILED DESCRIPTION OF THE INVENTION

Figure 1:
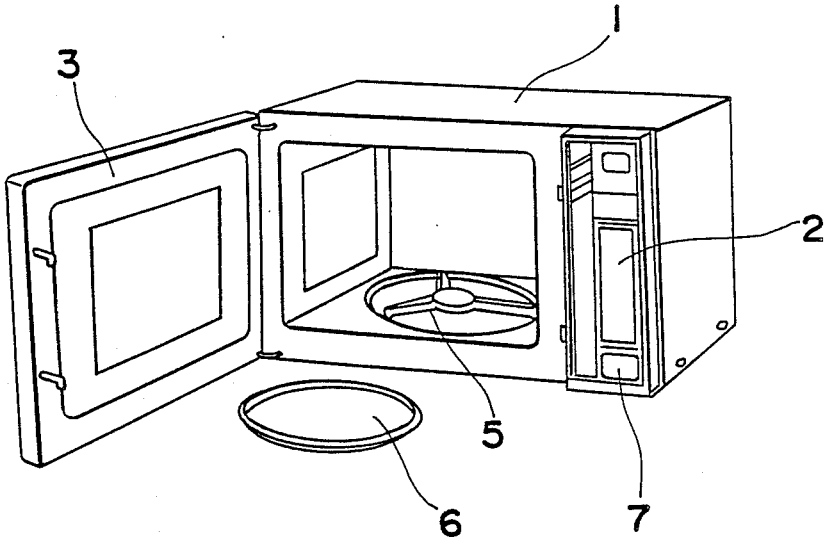
FIG. 1 is a view showing an outward appearance of a microwave oven according to the present invention.

Before the description of the present invention proceeds, it is to be noted that like parts are designated by like reference numerals throughout the accompanying drawings.

Referring to FIG. 1 showing an outward appearance of a microwave oven according to the present invention, the microwave oven is generally constructed by an outer case cabinet 1, a control unit 2, an oven door 3, a tray support 5, an oven tray 6 and a door opening switch 7. The tray support 5 supports the oven tray 6, and at the same time, transmits the rotating movement of a motor placed at the back of the outer case cabinet 1 to the oven tray 6, so that the oven tray 6 is rotated to irradiate microwaves uniformly onto a material to be cooked.

It should be understood that while a microwave oven has been herein described, the principles of the instant invention are applicable to a wide range of ovens.

Figure 2:
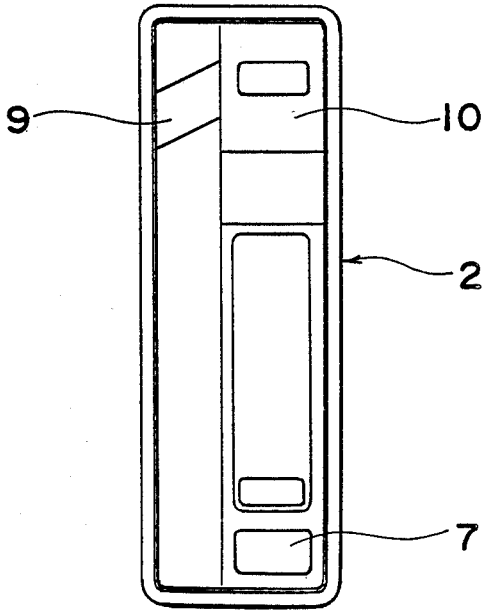
FIG. 2 is a front elevational view of a control unit of FIG. 1.

FIG. 2 is a front elevational view of the above-described control unit 2, on an enlarged scale, which has a cooking starting switch 9 and a covering panel 10.

Figure 3:
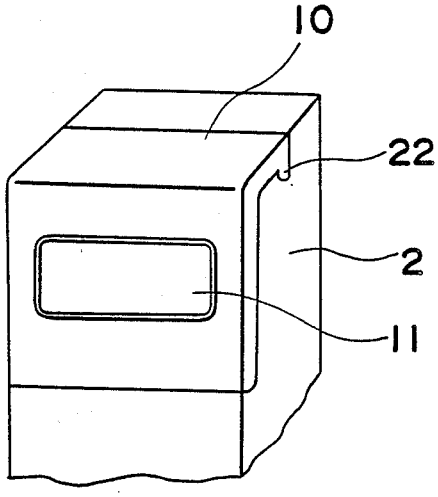
FIG. 3 is a perspective view of a covering panel of a function unit of FIG. 2.
Figure 4:
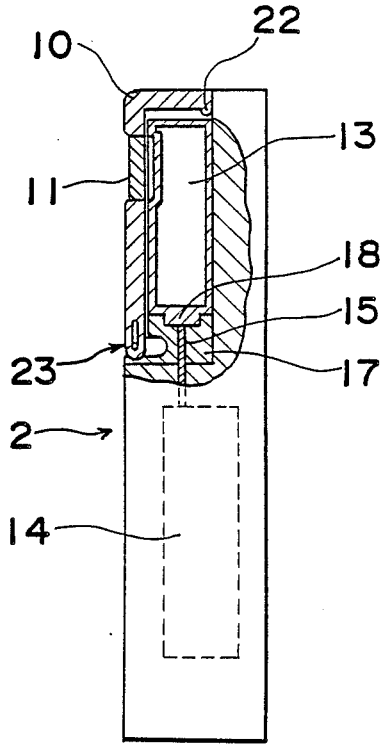
FIG. 4 is a longitudinal cross sectional view of an essential part of FIG. 2.

FIG. 3 is a perspective view of an upper part of the control unit 2 of FIG. 2, on an enlarged scale, and FIG. 4 is a cross sectional view of the control unit 2.

Referring to FIG. 3, the covering panel 10 defining the outline of the front upper part of the control unit 2 serves as a protective covering when a function unit 13 which will be described later is installed within the control unit 2 as shown in FIG. 4. A panel window 11 is made of a transparent material so that information outputted to a display 30 of the function unit 13 can be easily read even when the function unit 13 is installed in the control unit 2.

In FIG. 4, the function unit 13 is equipped with the menu selecting function to be described later which is the main feature of the present invention. A controlling member 14 controls the operation of the microwave oven on the basis of the cooking programs inputted through a signal transmission passage 15 from the function unit 13.

Figure 6:
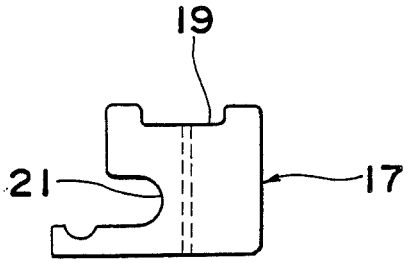
FIG. 6 is a side elevational view of an engaging element of FIG. 4.

An engagement element 17 provided in the control unit 2 has an engaging portion 19 formed in the upper part thereof as shown in FIG. 6. The engaging portion 19 is engaged with an engaging portion 18 of the function unit 13. Moreover, the engagement element 17 has an engaging portion 21 formed in the front part thereof to be engaged with the covering panel 10. The above-described signal transmission passage 15 is located inside the engagement element 17 and the control unit 2 so as to guide a signal transmitted from the function unit 13 to the controlling member 14.

Figure 5:
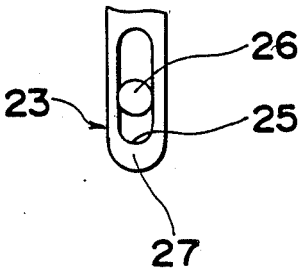
FIG. 5 is a view of an essential portion of a supporting part of the covering panel of FIG. 4.
Figure 7:
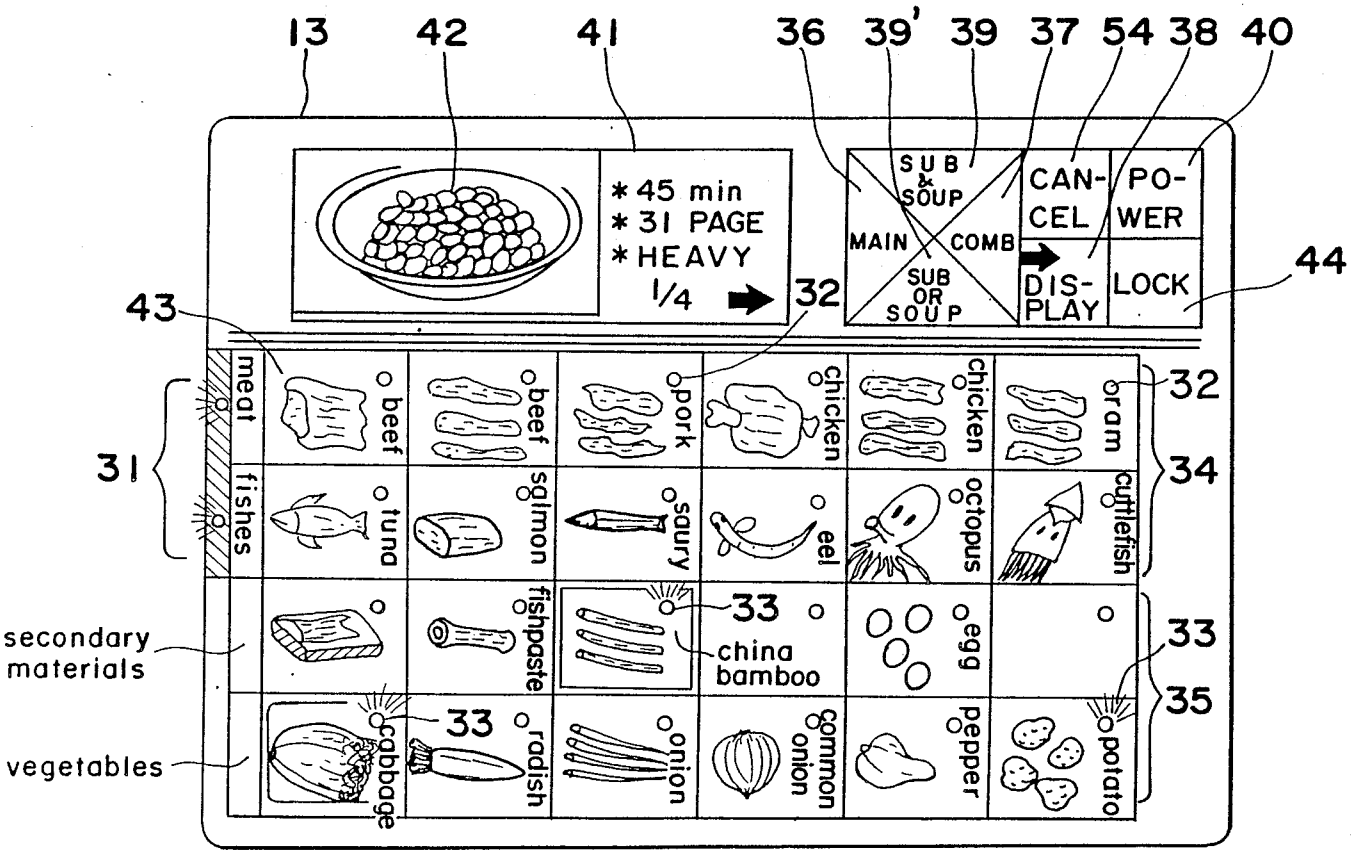
FIG. 7 is a front elevational view of the function unit of FIG. 4.

The covering panel 10 is fixedly secured through engagement of a convex portion 22 formed in the upper edge of the panel to a recessed portion of the control unit 2. On the other hand, in a support portion 23 formed in the lower edge of the covering panel 10, as shown in FIG. 5, a shaft pin 26 is inserted into an elongated hole 25 formed in the lower part of the covering panel 10, so that the covering panel 10 is rotatably secured. A front tip end 27 of the support portion 23 formed in the lower edge of the covering panel 10 is inserted into the engaging portion 21 of the engagement element 17, thereby securing the covering panel 10 when the covering panel 10 is rotated 9° in a horizontal direction FIG. 7 shows an outward appearance of the above-described function unit 13.

In the function unit 13, image information of candidate means is retrieved on the basis of the inputted main and secondary material information and displayed on a display means for selection.

The function unit 13 is generally comprised by a main material indicating lamp 31 for indicating groups of main materials, a main material inputting switch 34, a secondary material inputting switch 35, a mode key 36 for selecting the main dish mode, a mode key 37 for selecting the sub-dish mode, a menu member inputting switch 39 for inputting the number of sub-dishes a menu structure inputting switch 39' for inputting the structure of the sub-dishes, a display 41 for acting as a display means, a switch 38 for switching the image information on the display means 41 and a program locking switch 44 for locking the cooking program of a desired menu.

The above-described main material indicating lamp 31 is turned on so as to indicate the position of the main material inputting switch 34. The indicating lamp 31 flashes when the mode key 36 for selecting the main dish mode is depressed. Accordingly, an operator can readily move his or her finger to the inputting switch 34 from the mode key 36 without hesitation.

The inputting switch 34 is used when the main material is selected, while the inputting switch 35 is provided so as to designate the secondary material. An illustration 43 on the inputting switches 34 and 35 shows many materials for the main and secondary materials, so that the material to be selected through depression of the switch 34 or 35 can be easily confirmed.

An indicating lamp 32 indicates the fact that a specific main material has been selected and designated, which is turned on simultaneously when the main material inputting switch 34 is depressed. Therefore, the indicating lamp 32 helps the operator to visually confirm that the desired main material is correctly inputted.

On the other hand, an indicating lamp 33 indicates the secondary material to be inputted and selected. The indicating lamp 33 starts flashing a predetermined time later after the main material inputting switch 34 is depressed. Then, when the secondary material inputting switch 35 by the flashing indicating lamp 33 is depressed, the indicating lamp 33 stops flashing, but is continuously lighted, enabling the visual confirmation that the secondary material is correctly inputted. In the manner as described above, the secondary material inputting switch 35 to be depressed is indicated (to the operator) by flashing of the indicating lamp 33, whereby the operator can select the desired secondary material inputting switch 35 in a reduced time. Furthermore, if the desired menu has been tried before, it can be expected that the operator recalls the secondary material used in the desired menu. Moreover, in the case where the operator have not yet decide a menu to be inputted, image information of menus can always be outputted on the display 41 even if the operator selects a secondary material from his or her own sense subjectively.

The secondary material indicating lamp 33 together with the main material indicating lamp 32 informs the operator of combinations of the inputted main material and secondary material, thereby urging the operator to remember the combination of materials necessary for the selection of the specific menu. Moreover, the combination of materials can be contributed as a reference information when the inputted material information are changed for retrieval again.

Again the menu of the main dish is selected and designated, the sub-dish selecting mode key 37 is manipulated so as to select the mode for indicating image information of the sub-dish to be paired with the selected main dish.

The image switching switch 38 is used when the image information of many menus, which are retrieved based on the main and secondary material information designated in the manner as described above, are to be switched. By depressing the switch 38, the menu image information on the display 41 can be changed and turned over one by one. Image information 42 indicated on the display 41 can show the the menu, the necessary cooking time for the menu or a reference page of the cookbook, etc.

In order to designated the structure and the number of sub-dishes to be paired with the selected main dish, the inputting switches 39 and 39' are employed. In other words, when the switch 39 is depressed, one menu for the sub-dish and one menu for the soup are selected, while, when the switch 39' is depressed, one menu for the sub-dish or one menu for the soup is selected. The program locking switch 44 should be depressed when the desired menu is found among the menu image information which are indicated one by one on the display 41 through operation of the switch 38. Thereafter, any operation or depression of a switch is ineffective except when cancel key 54 is pressed two times.

When the above cancel key 54 is depressed one time, the microwave oven is returned to the condition where the first step in inputting of material information is finished, that is, the main material is inputted. Accordingly, the secondary material indicating lamp 33 which has been continuously lit before the cancel key 54 is depressed once begins to flash. If the cancel key 54 is pressed two times, the microwave oven is returned to the condition before the above-described first step is carried out. Subsequently, the main material indicating lamp 32 which has been turned on before the cancel key 54 is pressed two times is turned off.

The function unit 13 is supplied power from a battery (not shown). Therefore, the function unit 13 can be operated even when it is detached from the control unit 2 of the microwave oven.

Figure 8:
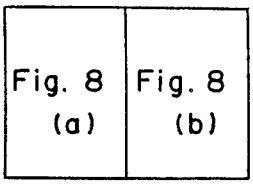
FIGS. 8, 8(*a*) and 8(*b*) are block diagrams of the function unit.
Figure 8:
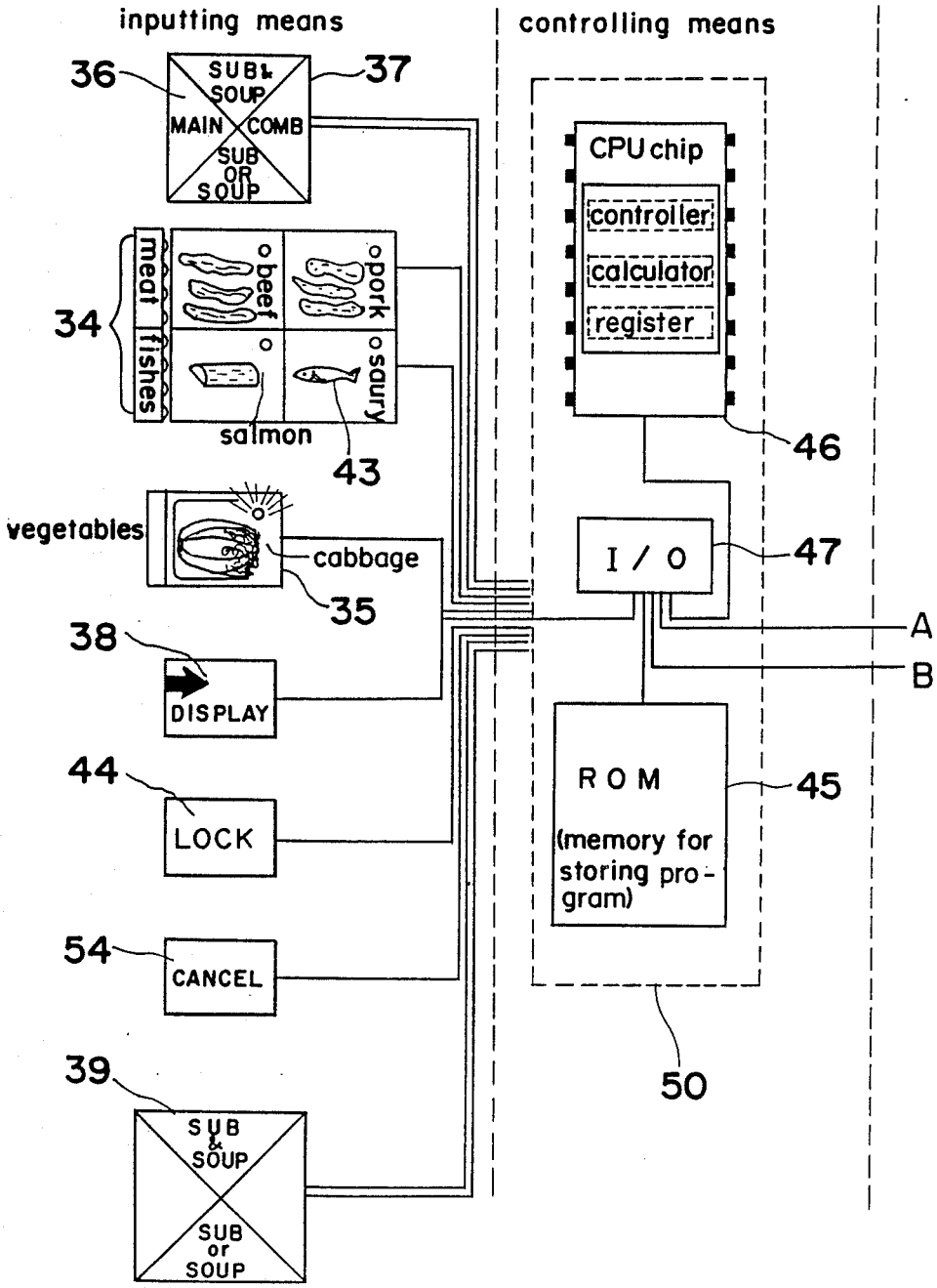
Figure 8B:
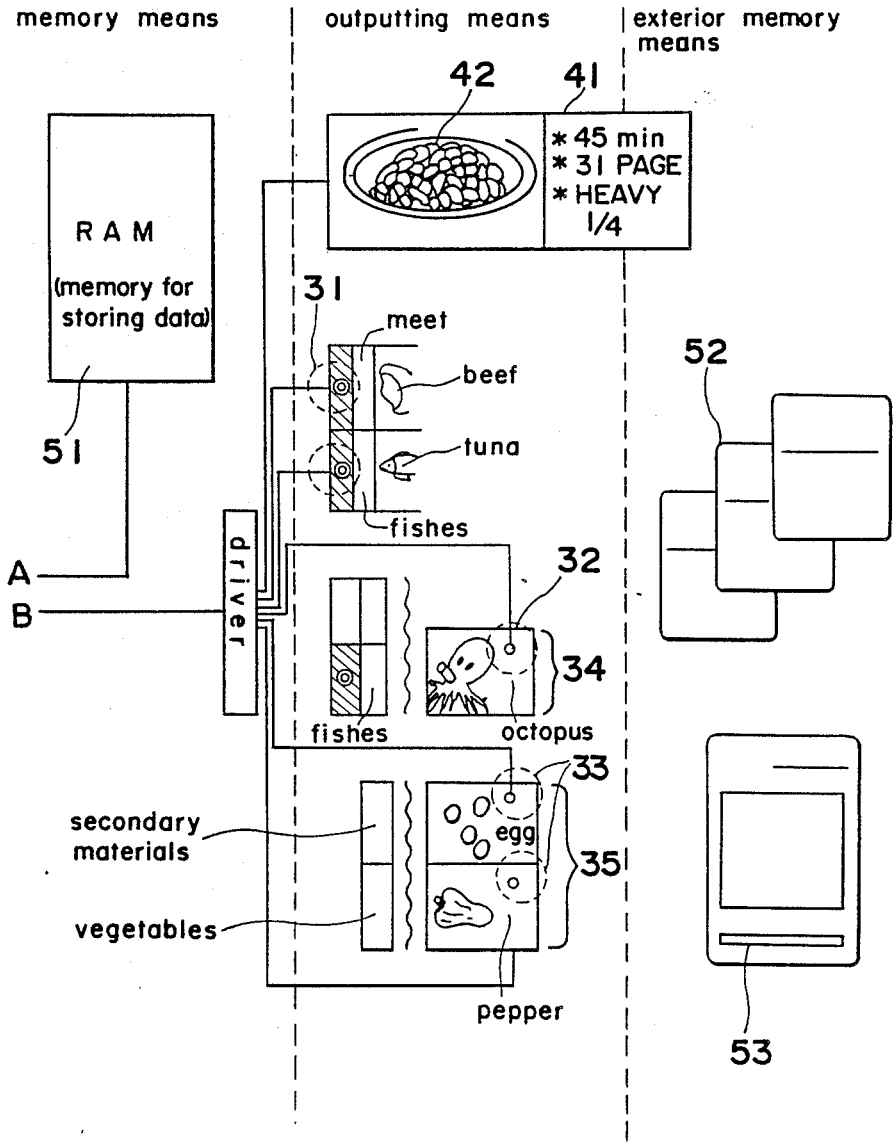

(FIGS. 8(*a*) and 8(*b*) are a block diagrams of the function unit 13 which is divided into groups of inputting means, controlling means, memory means, outputting means and exterior memory means for left to right in the drawings.

The group of inputting means inputs desired materials, and is comprised of the following means (A)–(D).

(A) An inputting means for selecting the operation mode of the function unit 13 (main dish selection mode key 36, sub-dish selection mode key 37).

(B) An inputting means for selecting and designating materials constituting the desired menu (main material ginputting switch 34, secondary material inputting switch 35).

(C) An inputting means for designating the number and the structure of sub-dishes (sub-dish number and structure inputting switches 39, 39').

(D) An inputting means for controlling the operation of the microwave oven;

(i) an inputting means for changing the outputted information on the display 41 (image switching switch 38), (ii) an inputting means for erasing already-inputted information (cancel key 54), and (iii) an inputting means which nullifies succeeding inputting operations for locking the retrieved cooking program (cooking program locking switch 44).

Meanwhile, the group of controlling means controls the operation of the function unit 13. The group of controlling means includes ROM 45, CPU 46 which controls the function unit 13 on the basis of the system program stored in advance in the ROM 45, and an input/output interface 47. The interface 47 is connected to each outputting means, CPU 46, ROM 45, the above-described inputting means, a memory means which will be described later and a driver 48. The ROM 45, CPU 46 and interface 47 constitute a microcomputer 50.

The memory means stores information necessary to operate the function unit 13. This memory means is constituted by RAM 51. The information stored in RAM 51 is supplied by an exterior memory means (RAM card 52), IC card 53) which will be described later.

The group of outputting means is comprised of the display 41 which outputs image information of the retrieved menus and, the following lighting means which indicates main and secondary material inputting switches 34 and 35 to be depressed:

(a) A lighting means for indicating the group of main materials (main material indicating lamp 31);

(b) A lighting means which indicates that the main material has been inputted (designated main material indicating lamp 32); and (c) A lighting means for indicating the secondary material to be inputted (secondary material indicating lamp 33).

The exterior memory means stores information which is to be supplied to RAM 51, and is comprised of RAM card 52 (battery-backed RAM), IC card 53 or the like.

FIG. 9 shows the construction of the above-mentioned RAM 51.

(1) Data Area for Retrieving the Main Dish

In the data area 55 for retrieving the main dish, menu codes, main and secondary material codes and image information codes for displaying the image information of the menu on the display 41 are stored.

(2) Data Area for Retrieving the Sub-dish

In the data area 56 for retrieving the sub-dish, there are stored menu codes, menu codes of main dishes to be paired with the sub-dishes, yes or no codes for designation of the soup and image information codes of the sub-dishes.

(3) Data Area for Image Information

Image information of each menu, image information codes for designating an image information and cooking program codes which will be described later, are stored in the image information data area 57.

(4) Data Area for Cooking Programs

In the data area 58 for cooking programs, there are stored cooking program information for each menu, and cooking program codes for designating a cooking program information.

(5) Data Area for Control

In the data area for control, although it is not shown in FIG. 9, cooking information of the menu designated by depression of the main material inputting switch 34 and the secondary material inputting switch 35 which will be described later in detail are transmitted from the above data areas 55, 56, 57 and 58, to be stored therein.

More specifically, until the operator finally decides the menu and depresses the cooking program locking switch 44, menu codes, image information codes, cooking program codes, etc. of all the candidate menus (that satisfy and agree with the selected material) are stored successively one by one. Thereafter, when the locking switch 44 is pressed, only the cooking program information of the selected menu is stored.

The functions of the function unit 13 in the above-described construction will be briefly described hereinbelow.

(1) The function unit 13 is an independent unit that can operate to display on the display, select the cooking program, input the selected cooking program, etc., which are functions of the control unit 2 of the microwave oven. The function unit 13 can be used even when detached from the control unit 2.

(2) The function unit 13 reads out information of the secondary materials required for the menus including the designated main material, on the basis of the inputted main material information, and flashes the secondary material indicating lamp 33.

(3) The function unit 13 searches out image information codes of the menus satisfying the inputted material information from the data area 55 or 56.

(4) The function unit 13 reads out image information codes from the data area 57 in RAM 51.

(5) The function unit 13 helps the operator to input material information.

In other words, the material information to be inputted by the function unit 13 is constructed by one kind of the main material and two kinds of the secondary materials. However, since the operator does not always know the materials of the desired menu well, the function unit 13 is effective to carry out the retrieval from limited given material information even in the case (a) where only the main material is inputted and in the case (b) where only the main material and one kind of the secondary material are inputted. It is needless to say that the less the material information is inputted, the more the menu image information is outputted.

In this case, the image information is stored in RAM 51 in such a manner that the number of the read-out image information is dependent on the details and particulars of the inputted material information. Specifically, (1) In the case where information of two kinds of the secondary material in addition to the main material information is inputted, the number of the image information is about 1–2.

(2) In the case where one kind of the secondary material information in addition to the main material information is inputted, the number of the outputted image information is approximately 4–5.

(3) In the case where only the main material information is inputted, not more than 10 image information is read out.

As described hereinabove, not only in the case where the operator is quite familiar with material information of the desired menu, but also in the case where the operator does not know the material information well, image information of the menus satisfying the inputted information can be outputted on the display 41. Accordingly, the image information of the desired menu can be positively indicated on the display 41.

(6) The function unit 13 displays the read-out image information on the display 41. Moreover, the function unit 13 changes the outputted image information one by one, through manipulating operation by the operator, to be indicated on the display 41.

(7) The function unit 13 locks the cooking program information of the desired menu through manipulation of the locking switch 44.

(8) If the function unit 13 is mounted in the control unit 2, the locked cooking program information is transmitted to the controlling member 14 by the function unit 13.

A particular switch (not shown) may be provided in the function unit 13 so that the cooking program information is transmitted by depressing the switch. Or, the transmission of the cooking program information may be started in such a manner that a special push button (not shown) provided with the engaging portion 19 of the engagement element 17 is depressed when the function unit 13 is mounted in the control unit 2.

(9) The function unit 13 can indicate on the display 41 the menu of the sub-dish (soup, vegetable) suitable to be paired with the desired main dish selected in the foregoing procedure, through manipulation of the switches 39 and 39'.

The function unit 13 having the above-described functions will operate in the following manner.

Figure 10:
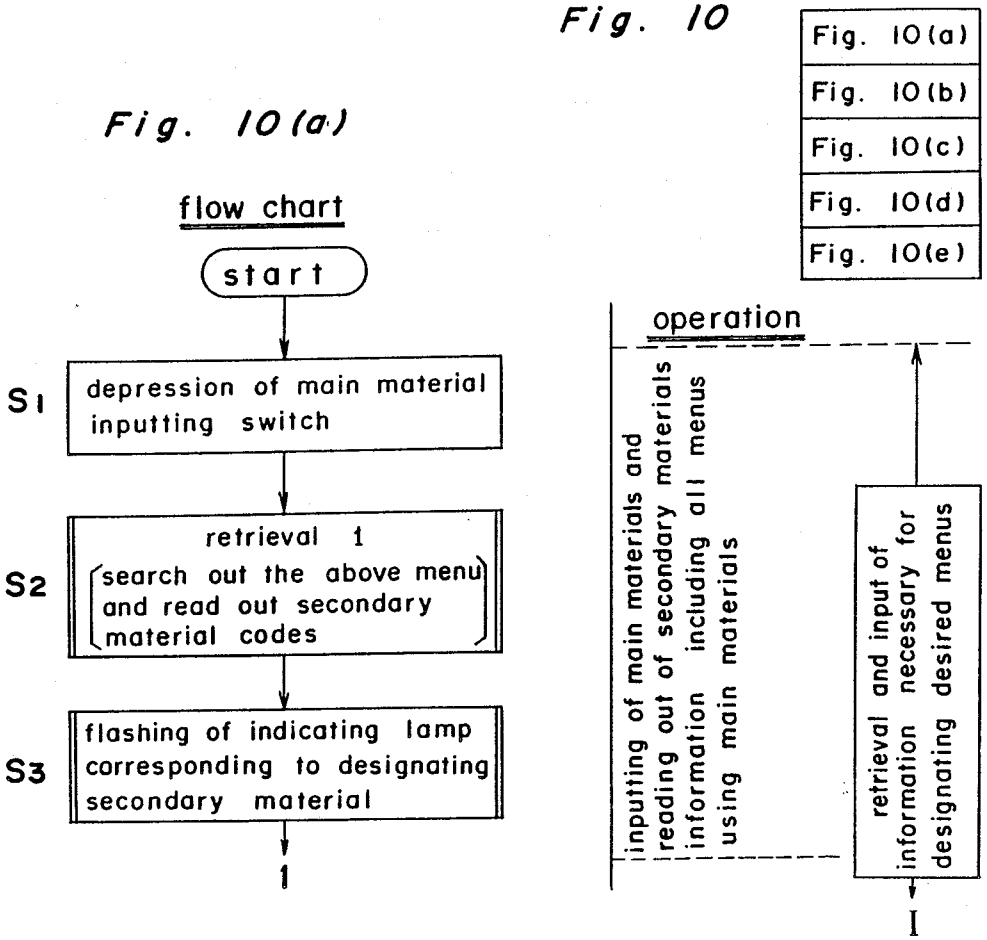
FIGS. 10, 10(*a*), 10(*b*), 10(*c*), 10(*d*) and 10(*e*) are flowcharts of operations when the cooking program is selected in the function unit.
Figure 10B:
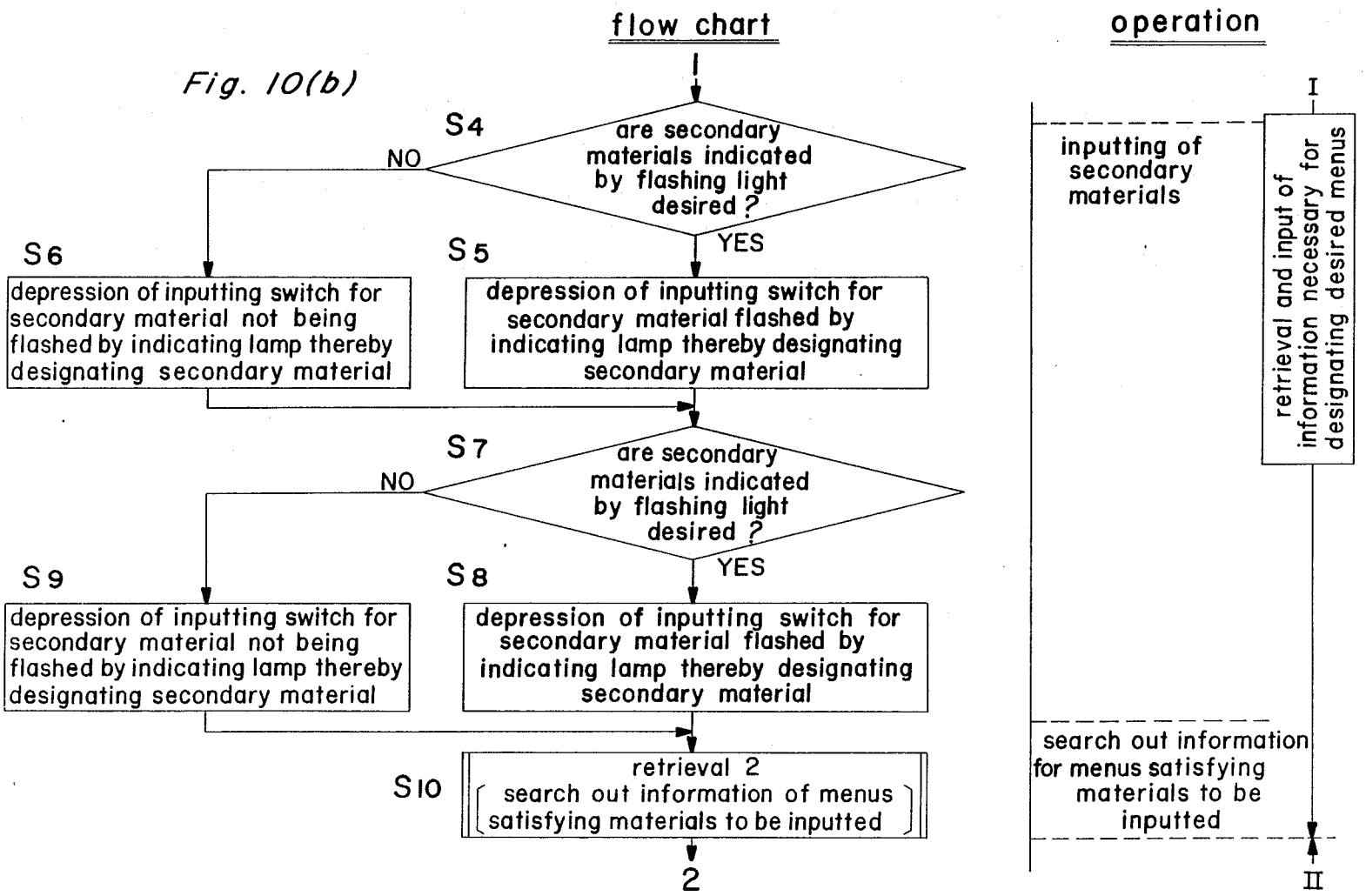
Figure 10C:
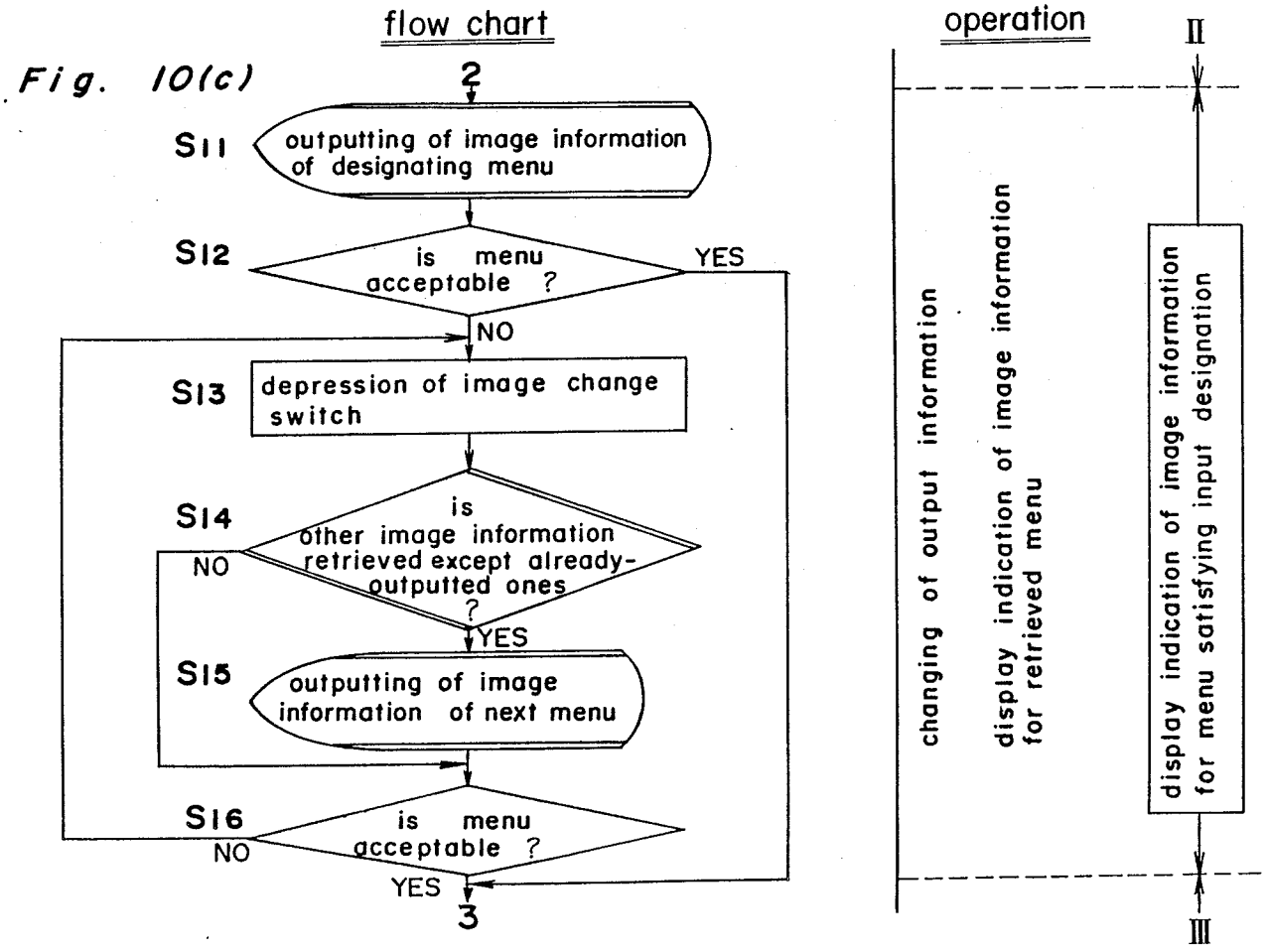
Figure 10D:
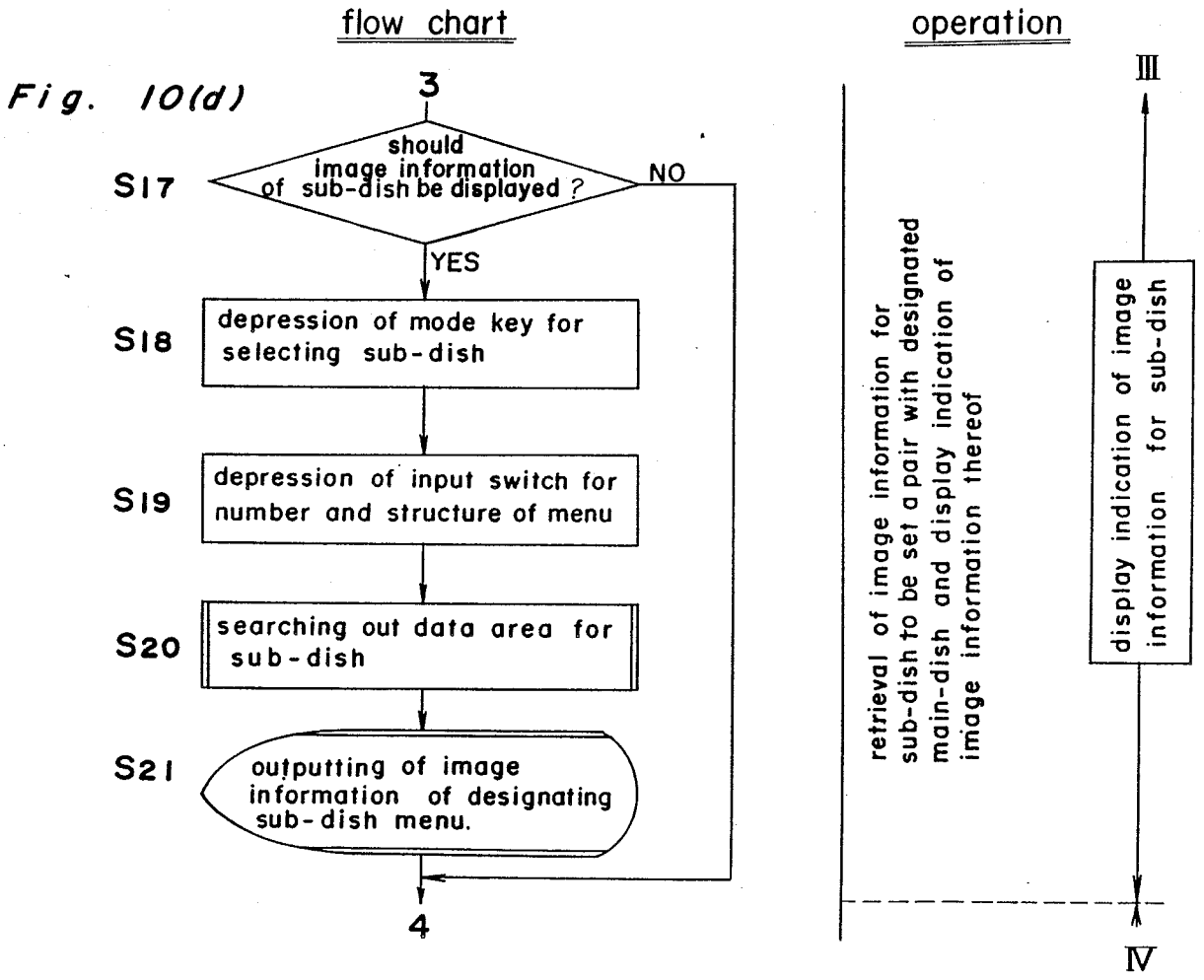
Figure 10E:
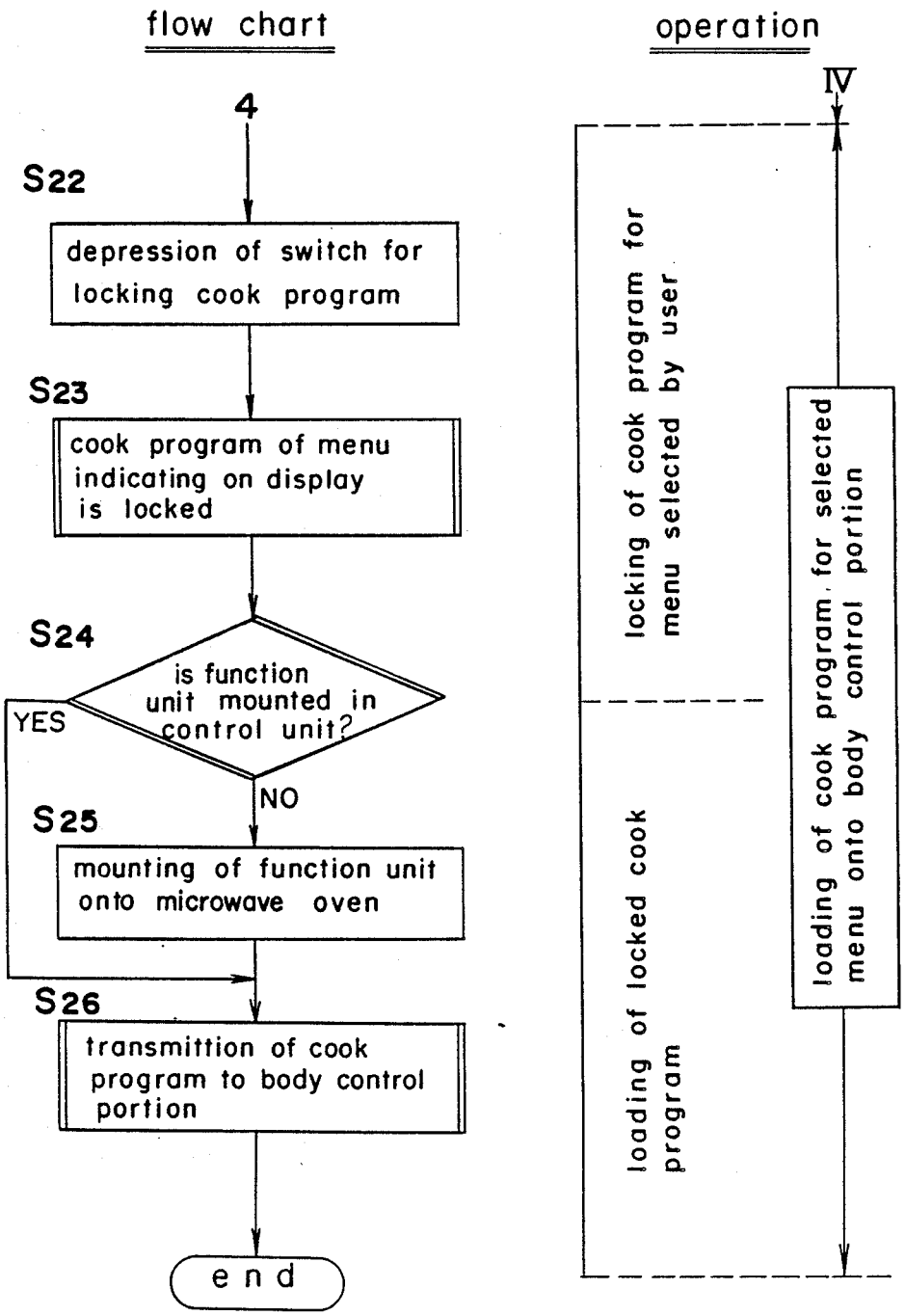

First, the operation of the function unit 13 will be schematically described with reference to the flowchart of FIG. 10 showing the selecting operation of the cooking program.

In step S1, a main material of the desired menu is selected by depression of the main material inputting switch 34, which is carried out on the basis of the operator's taste or impressions prior to eating Retrieval 1 is conducted in step S2.

The above-mentioned retrieval 1 is to search out the main material code of the main material selected in step S1 in the data area 55 of RAM 51, and then to read out all of the secondary material codes of the menus having the searched main material code.

In step S3, the indicating lamps 33 corresponding to the outputted secondary material codes are flashed.

In step S4, it is detected whether there are secondary materials which the operator wishes to select among the secondary materials flashed by the indicating lamp 33. Then, if there is any secondary material desired to be selected, the flow goes to step S5. Otherwise, the flow moves to step S6.

One of the secondary materials indicated by the flashing indicating lamp 33 is selected in step S5 through depression of the inputting switch 35.

In the above-described case, if the operator is not quite sure of the secondary material information of the desired menu, the operator has only to select the secondary material flashed by the indicating lamp 33, so that the desired menu is always searched out.

In step S6, one kind of the secondary material (secondary material 1) which is not indicated by a flashing indicating lamp 33 is selected by depression of the inputting switch 35.

Thus, in the manner as described above, an appropriate secondary material can be selected and inputted from the viewpoint of the combination with the inputted main material or tastes of the secondary material itself.

Another kind of the secondary material (secondary material 2) is selected in steps S7 through S9 in the similar manner as in steps S4–S6.

In this case, when only the main material should be inputted, steps S4–S9 may be skipped. On the other hand, when the main material and only the secondary material 1 are to be inputted, steps S7–S9 may be skipped. Accordingly, the combination of the main and secondary materials will be any one of (1) one kind of the main material and two kinds of the secondary materials, (2) one kind of the main material and one kind of the secondary material, and (3) one kind of the main material.

In step S10, retrieval 2 is performed.

The retrieval 2 is performed to retrieve the material codes of the above-selected main and secondary materials in the data area 55 of RAM 51 and to read out image information codes of the menus having the material codes.

An image information having the image information code retrieved in step S10 is indicated on the display 41 in step S11.

In step S12, if the menu, the image information of which is displayed on the display 41, is desired, the flow advances to step S17. Otherwise, the flow moves to step S13.

In step S13, the switch 38 is depressed, so that the image information indicated on the display 41 in step S11 is changed.

At this time, the number of image information from the above retrieval 2 and also the number of image information already outputted are indicated on the display 41 in the style of a fraction expression. In the embodiment of FIG. 7, the number $\frac{1}{4}$ indicated on the display 41 represents that four types of image information are obtained as a result of the retrieval 2, and the first one of the four types of image information is outputted at present.

It is detected in step S14 as to whether there are more image information retrieved except the already-outputted image information. If there is other image information, the flow goes to step S15. If there is no other image information searched, the flow goes to step S16.

In step S15, a succeeding image information is outputted on the display 41.

In the case where it is found in step S16 that the menu, the image information of which is indicated on the display 41, is preferable, the flow goes to step S17. If not, the flow returns to step S13.

In step S17, it is detected whether the image information of the sub-dish to be paired with the preferable main dish selected in step S16 should be indicated on the display 41. Depending on the result of this detection, the flow advances to step S18 or step S22.

In step S18, the sub-dish selection mode key 37 is depressed, so that the microwave oven is set in the sub-dish selection mode.

In step S19, the inputting switches 39 and 39' are depressed so as to determine the number and structure of the menu of the sub-dish.

In step S20, the main dish code of the selected main dish is searched in the data area 56 of RAM 51, and the image information of the menu of the sub-dish having the searched main dish code is read out.

The image information of the menu for the sub-dish read out in step S20 is indicted on the display 41.

In step S22, the cooking program locking switch 44 is depressed. When the cooking program locking switch 44 is depressed, the cooking program information of the main dish menu having the image information indicated on the display 41 is read out from a corresponding address in the data area 58 of RAM 51. So long as the cancel key 54 is not depressed, the cooking program information is in the locked condition even if the image information switching switch 38 is erroneously depressed.

Accordingly, the cooking program of the desired menu is finally selected.

It is judged in step S24 whether the function unit 13 is mounted in the control unit 2. If the function unit 13 is not mounted in the control unit 2, the flow moves to step S25. On the contrary, when the function unit 13 is mounted in the control unit 2, the flow skips over step S25 to step S26.

In step S25, the function unit 13 is mounted in the control unit 2.

In step S26, the locked cooking program information is transmitted to the controlling member 14 of the control unit 2.

Thus, the information of the cooking program of the desired menu is completely transmitted, thereby to finish the selecting operation of the cooking program.

In the case where two kinds of the secondary materials are inputted in the foregoing inputting process, if the two kinds of the secondary materials are not correct in terms of the combination therebetween, it is arranged to be so judged that one kind of the main material and one kind of the secondary material are selected. Threfore, even when the operator remembers the secondary materials ambiguously, it is possible for the operator to search out the menu information.

Figure 11A:
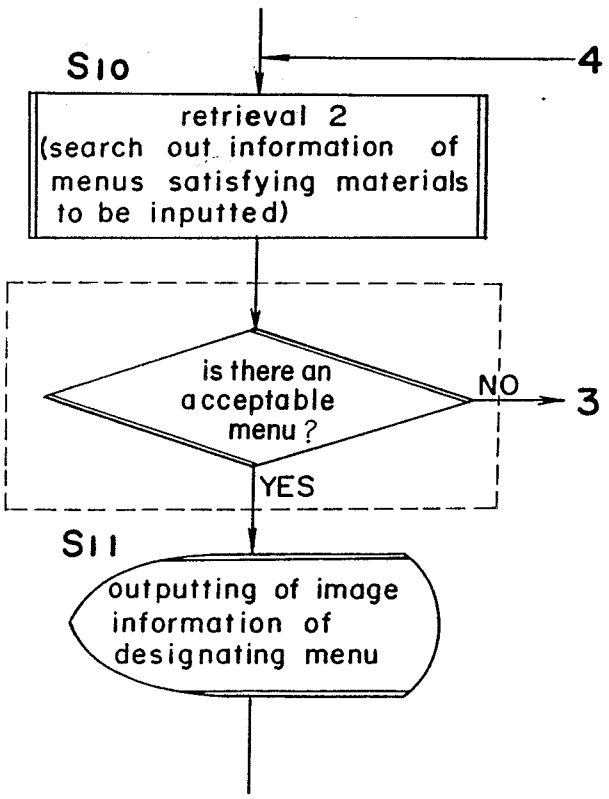
FIG. 11(*a*) is a flow-chart explaining the case where the flow is diverged to a routine for re-edition of the inputted information in the flow-chart of FIG. 10(*a*)
Figure 11B:
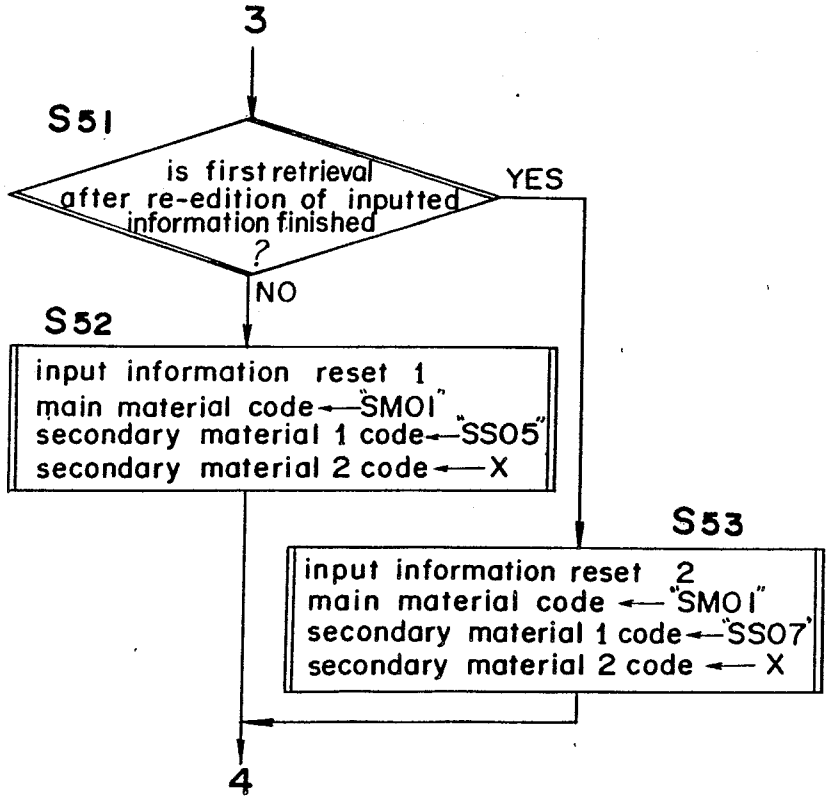

FIG. 11 is a flow-chart of a sub-routine used when the inputted information should be re-edited since the combination of the selected two kinds of the secondary materials is not suitable. In this case, it is understood by the microcomputer 50 that one kind of the secondary material is selected.

In other words, supposing that the main material code "SM01", the secondary material 1 code "SS05", and the secondary material 2 code "SS07" are selected, when it is found, as shown in FIG. 11(*a*), that there is not any menu including the material codes "SM01", "SS05" and "SS07" after retrieval 2 is carried out in step S10 as shown in the flow-chart of FIG. 10, the flow moves to the sub-routine for re-editing the inputted information as shown in FIG. 11(*b*), so that the inputted information is re-edited in the following manner.

It is decided in step S51 whether the first retrieval after the re-edition of the inputted information is finished. If the first retrieval is finished, the flow goes to step S53. If it is not finished, the flow goes to step S52.

In step S52, the inputted information is reset the first time, and accordingly, the main material code and the secondary material 1 and 2 codes are set respectively to "SM01", "SS05" and "no designation". Then, the flow moves back to step S10 in the flow-chart of FIG. 10.

In step S53, the inputted information is reset again for the second time, and another group of the main material code, secondary material 1 and 2 codes are reset respectively to "SM01", "SS07" and "no designation". Then, the flow returns to step S10 in FIG. 10.

Figures 12, 12A, 12B, 12C, 12D, 12E, 12F:
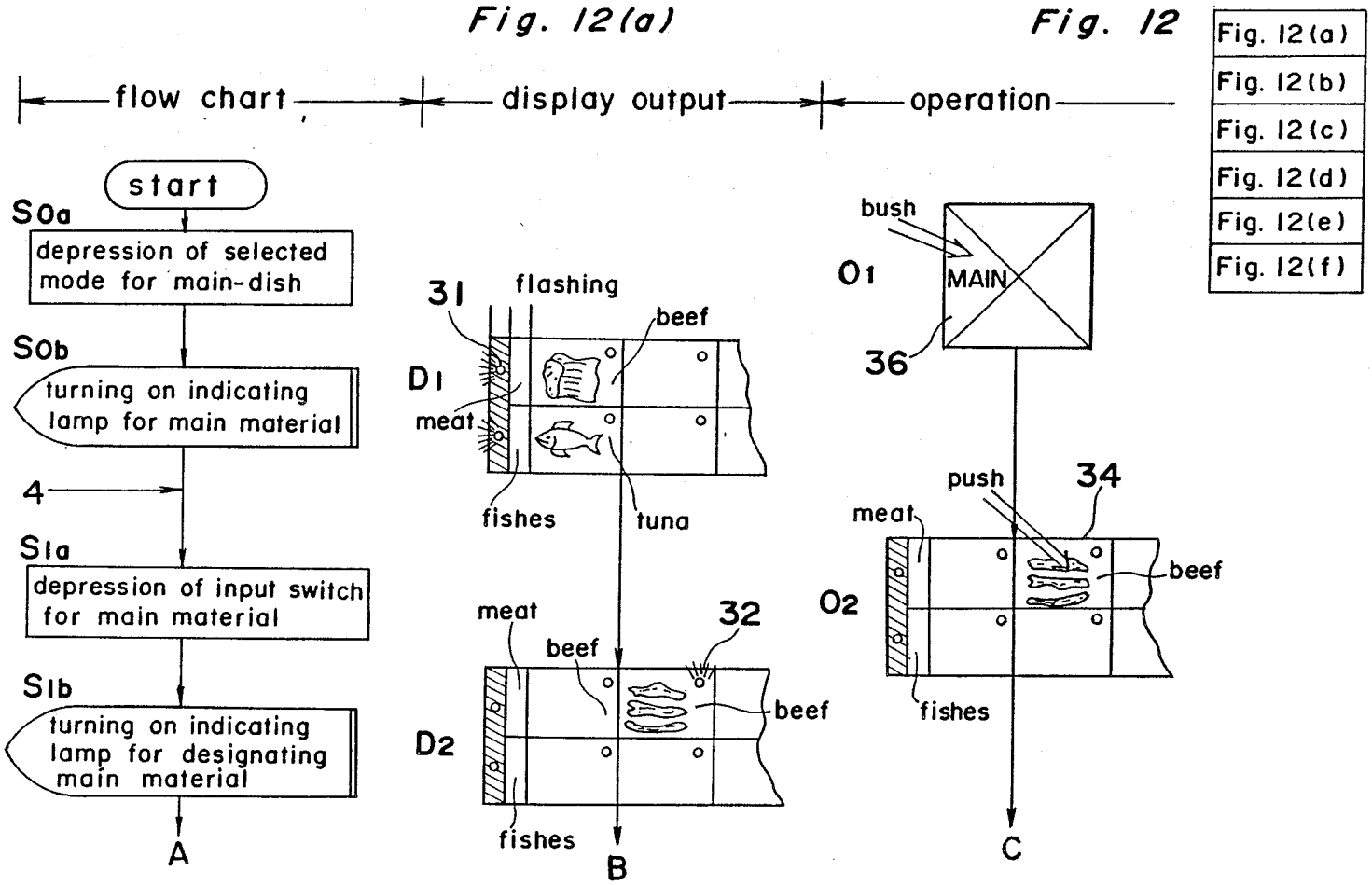
FIGS. 12, 12(*a*), 12(*b*), 12(*c*), 12(*d*), 12(*e*) and 12(*f*) are flow-charts showing the operations when the cooking program is selected.
Figure 12C:
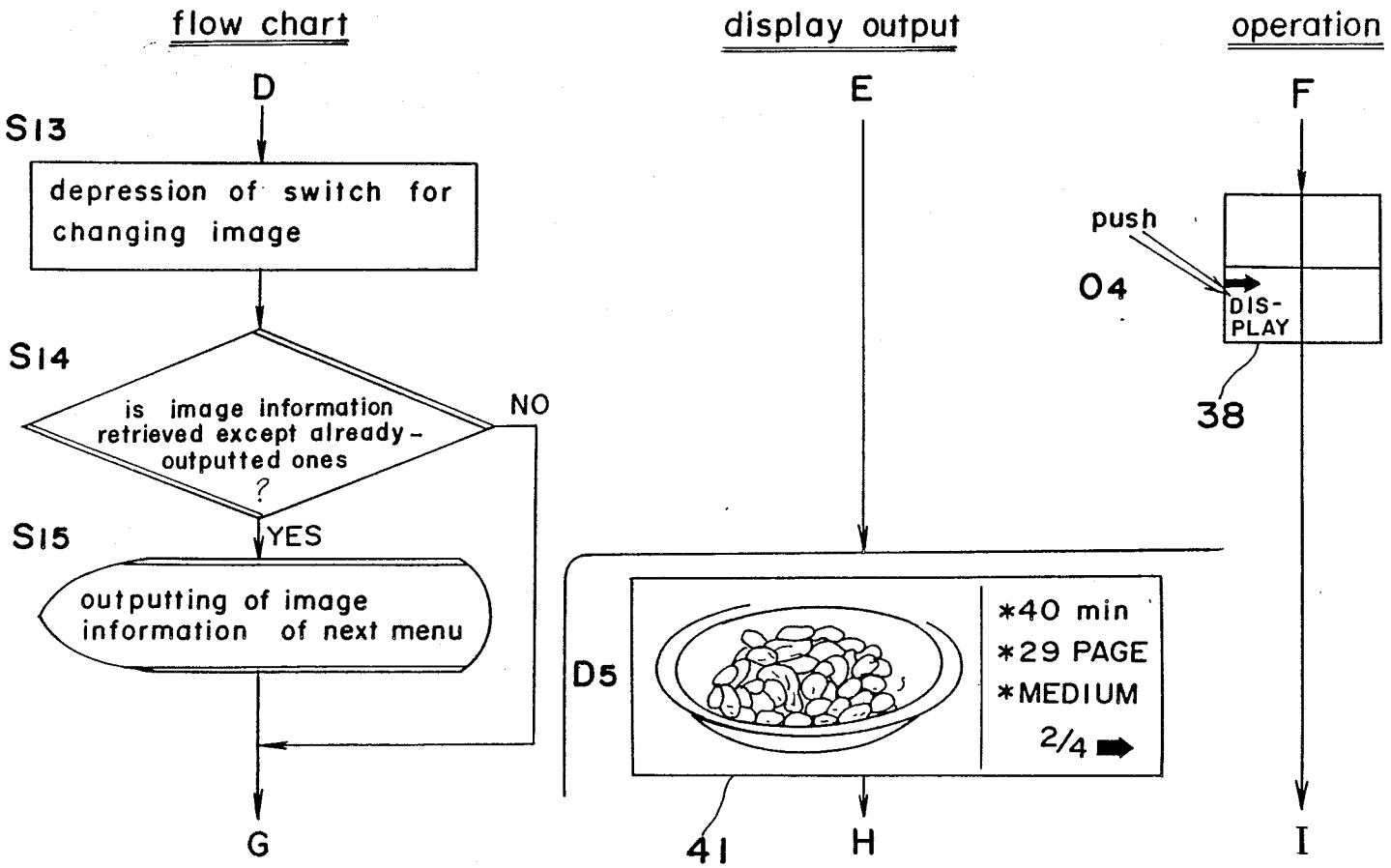
Figure 12D:
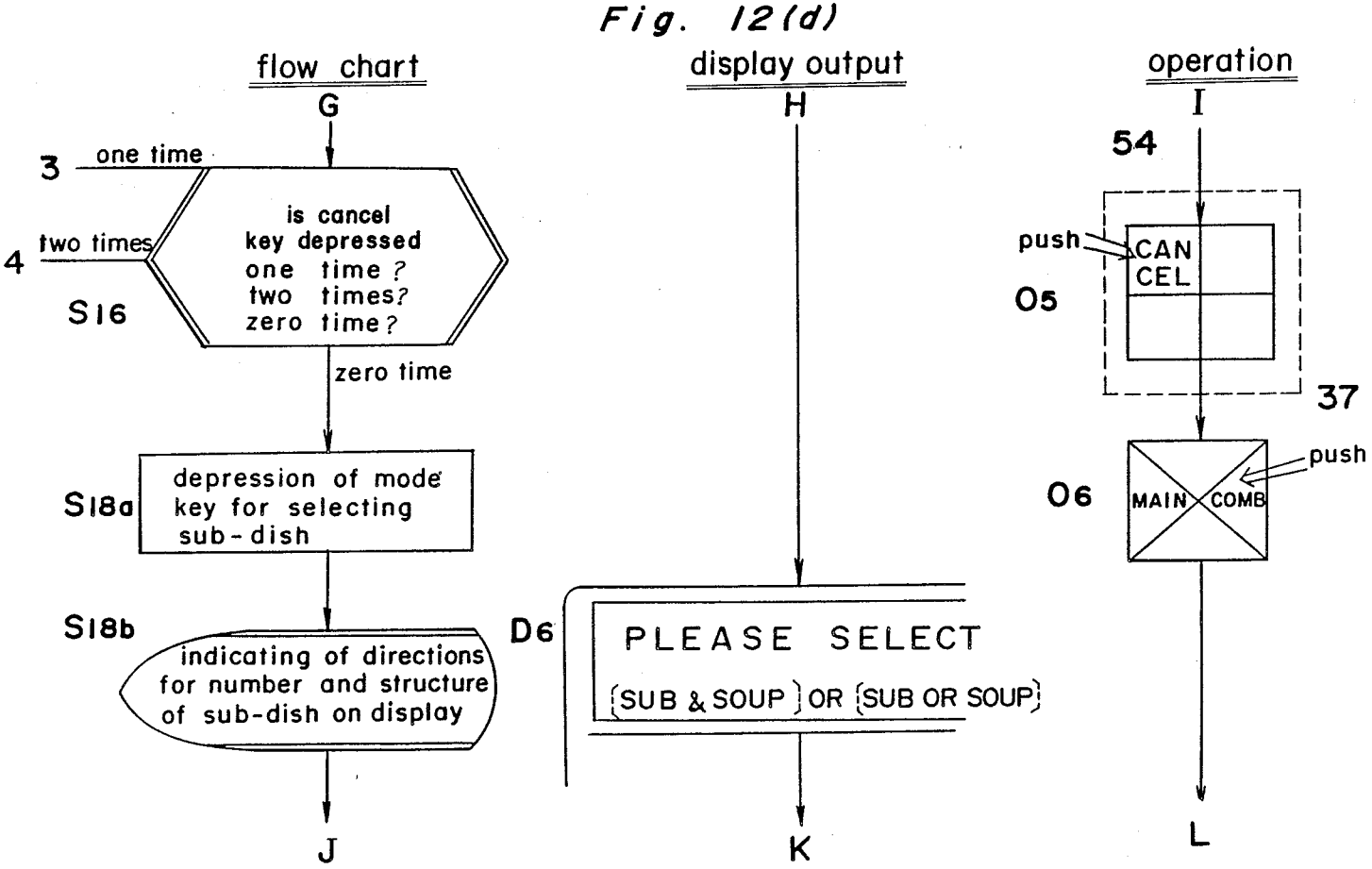
Figure 12E:
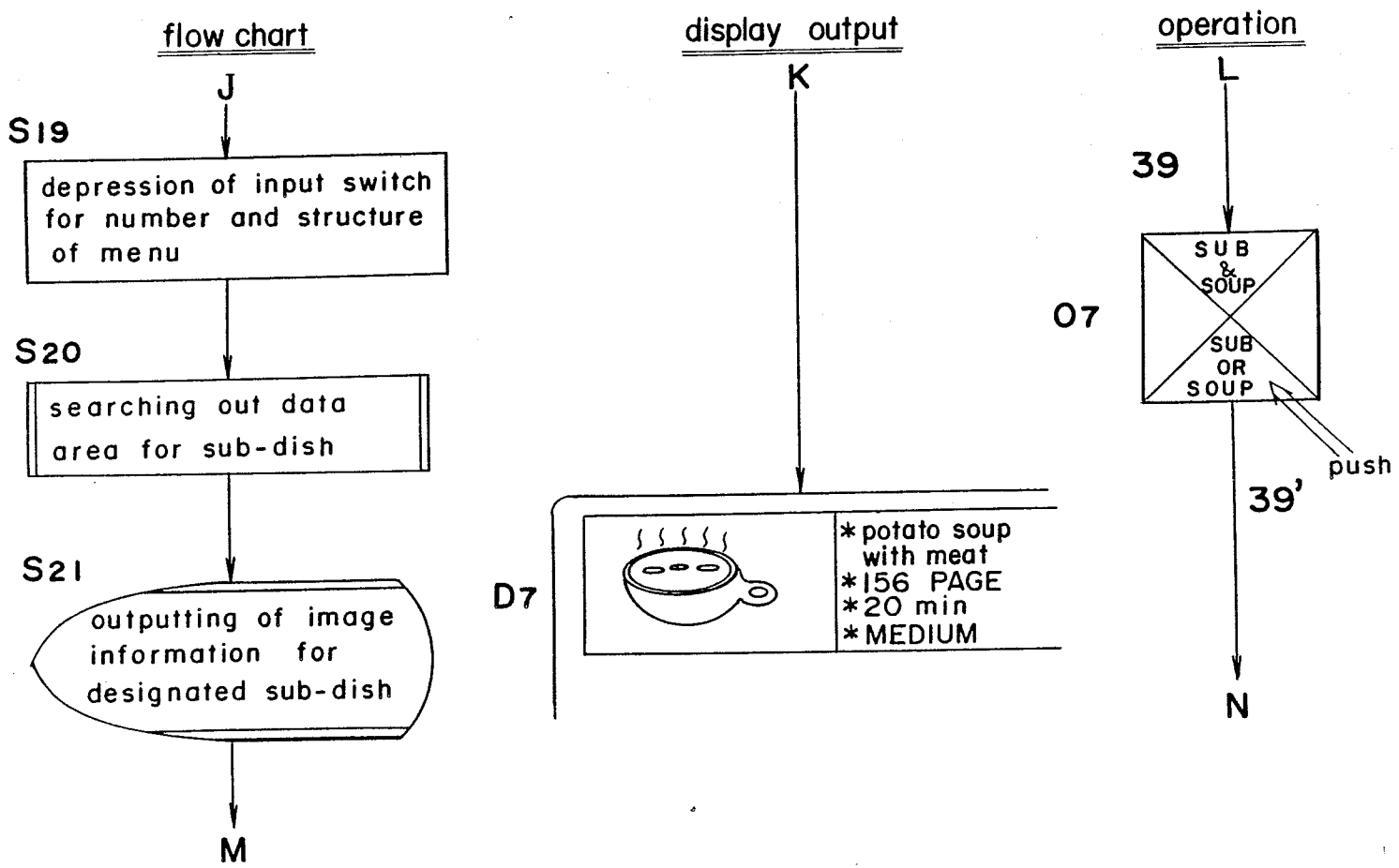
Figure 12F:
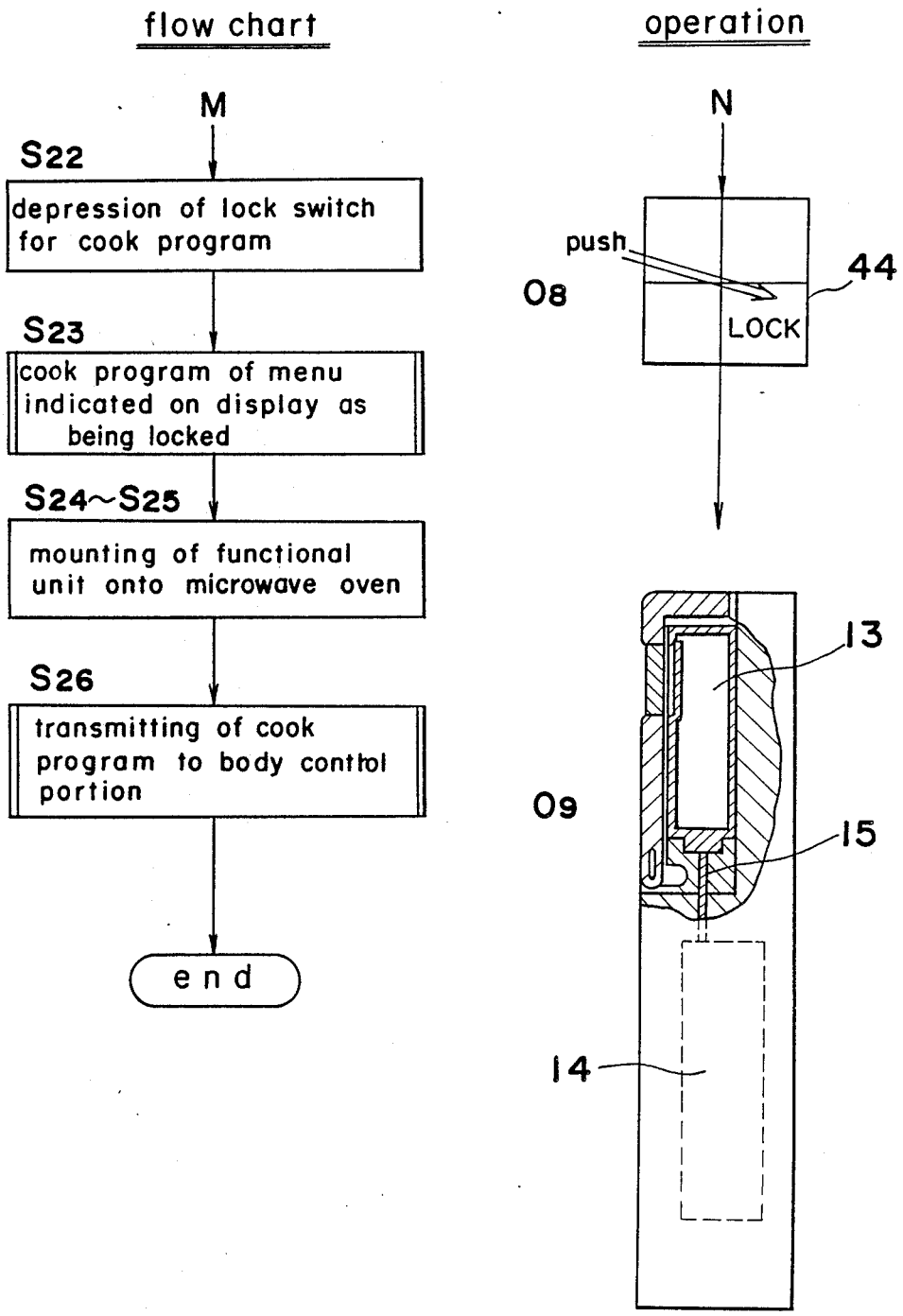

Referring to FIG. 12, the operating method of the function unit 13 will be described. There are indicated at the right, center and left in the drawing, respectively, how to operate the function unit 13 at the inputting time, the outputted contents on the display 41 flashed by the indicating lamp 31 and the indicating lamps 33 and 32 when the function unit 13 is operated, and a flow-chart based on the flow-chart of FIG. 10.

The step number in the flow-chart of FIG. 12 is the same step number as in FIG. 10. When a group of sequential steps in the flow-chart of FIG. 12 represents specified contents of one step of FIG. 10, the step number of the group of sequential steps in FIG. 12 is expressed by the corresponding step number of FIG. 10 which has an alphabet representing the specification added at the end thereof. On the other hand, when many steps in FIG. 10 are represented by one step in FIG. 12, the step number of the starting step and also the step number of the ending step of the many steps are used for the one step.

1. Selection of mode (steps S0*a*–S0*b*):

As shown in the operation step O1, the main material indicating lamp 31, which shows the group of the main materials, flashes as indicated in the display step D1.

2. Selection and determination of main material (steps S1*a*–S1*b*):

In step S1*a*, the main material inputting switch 34, which indicates the desired material (for example, beef in FIG. 12(*a*)), is depressed as shown in the operation step O2.

In step S1*b*, the indicating lamp 32, for indicating the selected main material and which is provided with the inputting switch 34 depressed in step S1*a*, flashes as shown in the display step D2.

3. Selection and determination of secondary materials (steps S2–S10):

In step S2, simultaneously when the inputting switch 34 is depressed in the operation step O2, the earlier-described retrieval 1 is carried out.

In step S3, the indicating lamp 33 corresponding to the secondary material code read out by the above retrieval 1 flashes as shown in the display step D3.

In steps S4–S9, as indicated in the operation step O3, the inputting switch 35 is depressed so as to input and select the secondary material (in FIG. 12(*a*), the foregoing sequence of operations is carried out twice so that two kinds of the secondary materials are selected). In this case, the operator can select any secondary material that is indicated by the flashing indicating lamp 33 or that is not flashed by the indicating lamp 33.

In step S10, the earlier-referred retrieval 2 is conducted simultaneously with the depression of the switch 35 in the operation step O3.

4. Output of image information on the display (steps S11–S15)

In step S11, an image information corresponding to the image information code read out by the retrieval 2 is displayed on the display 41 as shown in the display step D4.

In step S13, in the case, for example, where the menu represented by the image information display in step S11 is not the desired one, the image switching switch 38 is depressed the necessary amount of times as shown in the operation step O4.

In step S14, it is detected whether or not there is a lot of image information read out by the retrieval 2. When a lot of image information is read out, the flow proceeds to step S15. Otherwise, the flow goes to step S16.

In step S15, a succeeding image information is indicated on the display 41 as shown in the display step D5.

The display in the display step D5 represents that four kinds of image information are obtained through the retrieval 2, and the second image information among the four is outputted on the display 41 in step S15, with the two more kinds of image information remaining to be outputted.

5. Cancel of inputted information (step S16):

In step S16, the cancel key 54 is depressed in the operation step O5 if no desirable menu is found among all the image information switched and outputted one by one on the display 41. In this case, if only the secondary material information is to be erased from all of the inputted information, the cancel key 54 should be depressed once. If both the main and the secondary material information is to be erased, the cancel key 54 should be depressed two times. Consequently, the flow returns to step S4 when the cancel key 54 is depressed one time, or the flow returns to step S11 if the cancel key 54 is depressed two times, so as to carry out the inputting operation, retrieving operation and outputting operation again.

6. Selection and display of the sub-dish (steps S18*a*–S21)

In step S18*a*, the mode key 37 for selecting the sub-dish mode is depressed as indicated in the operation step O6, so that the sub-dish selecting mode is set.

Then, in step S18*b*, directions for the number and structure of the sub-dish are indicated on the display 41 as shown in the display step D6.

In step S19, the switches 39 and 39' are depressed as indicated in the operation step O7, so that the number and structure of the sub-dish are determined.

In step S20, the main dish code of the main dish finally indicated in step S17 is retrieved in the data area 56 of RAM 51, and the image information of the sub-dish to be paired with the main dish is outputted. In step S21, the image information of the sub-dish read out in step S20 is shown on the display 41 as seen in the display step D7.

7. Locking of cooking program (steps S22–S23)

In step S22, as indicated in the operation step O8, the cooking program locking switch 44 is depressed when the image information of the desired menu is shown on the display 41.

In step S23, the cooking program code of the image information finally outputted on the display 41 in step S15 is read out, and based on the output, the cooking program information from the data area 58 is locked. The cooking program information is in the locked condition until the cancel key 54 is depressed.

8. Mounting of the function unit into the control unit of the electronic oven and transmission of the cooking program (steps S24–S26)

In steps S24 and S25, if the operator determines the cooking program while the function unit 13 is detached from the cooking unit 2, then the function unit 13 should be mounted in the control unit 2.

In step S26, simultaneously when the function unit 13 is installed within the control unit 2 as shown in the operation step O9, the cooking program information is transmitted to the controlling member 14 of the control unit 2 via a signal transmission passage 15 formed within the control unit 2.

FIG. 13 is a flow-chart showing the flow of information when the cooking program is determined in the above-described manner. The flow of information will be explained hereinbelow with reference to FIGS. 9 to 13.

In step A1, information of the main and secondary materials is inputted through depression of the switches 34 and 35, respectively.

In step A2, the retrieval 2 is carried out.

In step A3, the menu code and the image information code of the menu stored in the address having the material code of the materials inputted in step A1 are read out from the data area 55 to be then transmitted to the data area 59 in RAM 51 for controlling the operation of the microwave oven.

In step S4, the cooking program code stored in the address having the image information code read out in step A3 is read out from the data area 57 to be transmitted to the data area 59. Concurrently, the image information stored in the data area 57 is read out with the help of the image information code.

In step A5, the image information read out in step A4 is outputted on the display 41.

In step A6, it is judged whether the image information outputted on the display 41 should be switched to a succeeding one. If the image information should be switched, the flow returns to step A4.

In step S7, the cooking program locking switch 44 is depressed.

In step A8, when the locking switch 44 is depressed, the cooking program of the main dish menu transmitted to the display 41 is read out from the data area 58 and transmitted to a corresponding address in the data area 59.

In step A9, the function unit 13 is mounted in the control unit 2.

In step A10, the cooking program information in the data area 59 is transmitted to the controlling member 14.

In this case, when the image information of the sub-dish to be paired with the selected main dish is desired to be indicated on the display 41, a menu code area and an image information code area for the sub-dish should be secured in the data area 59, so that the menu code and the image information code of the sub-dish are retrieved from the data area 56 on the basis of the menu code of the main dish read out in step A3, to be transmitted to the data area 59.

As described above, according to the microwave oven of the present invention, a menu is set by inputting materials required for the menu through depression of the special switches 34 and 35 assigned respectively exclusively for inputting the main material and the secondary material with illustrations drawn thereon This operation is much more simpler than the conventional method using numerical codes for determination of the menu. Further, even when a desired menu is not yet fixed , all of the menus which require the inputted materials are arranged to be retrieved and indicated on the display. Accordingly the microwave oven of the present invention is helpful in determining the menu. In this case, if the operator is not quite sure about all of the necessary secondary materials (two kinds of the secondary materials) for the desired menu, or the combination of the secondary material with the main material is not proper, may menus including the desired menu are outputted so long as the operator correctly knows the main material of the desired menu. The operator can therefore determine the final desired menu among the outputted menus.

In the function unit 13, since the indicating lamp 33 indicates, by flashing, the secondary material to be selected, the operator can easily select and input the secondary material in a short time.

Moreover, since a series of cooking information processed in the function unit 13 (for example, menu image information, cooking program information) are supplied from the exterior memory means (RAM card 52, IC card 53) for each menu, the electronic oven provided with the function unit 13 can enjoy a large repertoire of cooking menus.

Image information of many menus obtained as a result of the retrieval can be changed by the switch 38 one by one to be shown on the display 41 because of the function unit 13, and therefore the number of menus to be indicated on the display 41 is not limited in terms of the space of the display 41. In addition, the result of the retrieval can be easily confirmed as to whether it is the desired menu.

Moreover, in the function unit 13, the image information of the sub-dish to be paired with the alreadyselected main dish is arranged to be indicated on the display 41 by the switches 39 and 39'. Therefore, the structure of the total menu can be designed easily.

Since the above function unit 13 is detachable from the control unit 2 of the microwave oven, an operator, for example, a working housewife can bring the function unit 13 for use during lunch time or in a commuting train.

For another embodiment, if the material list for each menu is arranged to be outputted on the display 41 in the same manner as the menu image information, the function unit 13 may be useful as a portable guide for shopping.

As is clear from the above-described embodiment, the microwave oven according to the present invention is provided with the detachable function unit which includes the cooking information memory means, material inputting means, cooking information retrieving means, image display means, image switching means, cooking program locking means and cooking program transmission means, so that cooking information such as menu image information, cooking programs, etc. are retrieved on the basis of the inputted material information, and the cooking program of a desired menu among the menu image information changed one by one on the basis of the results of the retrieval is selected and locked. When the function unit 13 is mounted in the main body of the microwave oven, the locked cooking program can be transmitted to the controlling member of the main body. Accordingly, when a desired menu is not determined yet, or the correct code of the menu is not remembered, only simple operations are required to realize the final desired menu among many menus. Also, the cooking program of the determined menu can be inputted into the controlling member of the main body.

Furthermore, the microwave oven of the present invention includes two inputting means respectively for inputting a main material and inputting a secondary material, and the indicating means for indicating the secondary material to be selected. The above indicating means is arranged to be operated in accordance with the information of the secondary material read out on the basis of the main material information inputted by the main material inputting means, and therefore the secondary material can be inputted easily in a short time.

The microwave oven of the present invention is further provided with the indicating means of the sub-dish information. Accordingly, the image information of the sub-dish to be paired with the selected main dish can be displayed on the display, which will be highly useful in planning the total structure of the dishes.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An oven including a main body, a heating chamber, a heating means for heating food material placed inside the heating chamber, means for controlling operation of the oven and a function unit which is readily detachable from the main body, said function unit comprising:

cooking information memory means for storing cooking information, said cooking information including at least food material information, menu image information and cooking programs, said food material information relating to type of food material to be cooked, said menu image information includes at least one of a picture of the cooked food material obtained with a menu, necessary cooking time for a menu and a reference page of a cookbook for a menu;

material input means for selecting a specific food material and the material information for that specific food material;

cooking information retrieval means for retrieving menu image information and cooking programs from said cooking information memory means in response to selection of a specific food material by said material input means;

display means for displaying menu image information retrieved by said cooking information retrieval means in response to the selection of a specific food material by said material input means;

switching means for changing menu image information displayed by the display means when a plurality of menu image information is retrieved by said cooking information retrieval means whereby succeeding menu image information can be sequentially displayed by operation of said switching means;

cooking program lock means for preventing changing of the menu image information by said switching means and for holding a cooking program associated with a displayed menu image information; and cooking program transmission means for transmitting the cooking program held by said cooking program lock means to the means for controlling operation of the oven when the function unit is mounted in the main body of the oven, whereby a cooking program for a food material selected by the material input means can be transmitted to the means for controlling operation of the oven.

2. The oven as claimed in claim 1, wherein said material input means comprises a main material input means for inputting information for a main material and a secondary material input means for inputting information for a secondary material, and said cooking information memory means memorizes cooking information for both the main material and the secondary material, the main material information being inputted first by a main material input means

3. The oven as claimed in claim 2, further comprising a secondary material indicating means for indicating a secondary material to be selected, wherein said secondary material indicating means is operated in accordance with secondary material information read out by the cooking information retrieval means from said cooking information memory means in response to input of the main material information inputted by the main material input means.

4. The oven as claimed in claim 3, further comprising a sub-dish information indicating means, said sub-dish information indicating means being operated after a menu of a main dish is determined whereby image information for the sub-dish to be paired with the determined main dish is displayed on said display means.

5. The oven as claimed in claim 2, further comprising a sub-dish information indicating means, said sub-dish information indicating means being operated after a menu of a main dish is determined whereby image information for the sub-dish to be paired with the determined main dish is displayed on said display means.

6. The oven as claimed in claim 1, further comprising a secondary material indicating means for indicating a secondary material to be selected, wherein said secondary material indicating means is operated in accordance with secondary material information read out by the cooking information retrieval means from said cooking information memory means in response to input of a main material information inputted by a main material input means.

7. The oven as claimed in claim 3, further comprising a sub-dish information indicating means, said sub-dish information indicating means being operated after a menu of a main dish is determined whereby image information for the sub-dish to be paired with the determined main dish is displayed on said display means.

8. The oven as claimed in claim 1, further comprising a sub-dish information indicating means, said sub-dish information indicating means being operated after a menu of a main dish is determined whereby image information for the sub-dish to be paired with the determined main dish is displayed on said display means.

* * * * *